US011905092B2

(12) United States Patent
Schneider et al.

(10) Patent No.: US 11,905,092 B2
(45) Date of Patent: Feb. 20, 2024

(54) PACK FOR PRODUCTS OF THE TOBACCO INDUSTRY

(71) Applicant: Focke & Co. (GmbH & Co. KG), Verden (DE)

(72) Inventors: Christoph Schneider, Verden (DE); Henry Buse, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 17/781,533

(22) PCT Filed: Dec. 1, 2020

(86) PCT No.: PCT/EP2020/084158

§ 371 (c)(1),
(2) Date: Jun. 1, 2022

(87) PCT Pub. No.: WO2021/110696

PCT Pub. Date: Jun. 10, 2021

(65) Prior Publication Data

US 2023/0002135 A1 Jan. 5, 2023

(30) Foreign Application Priority Data

Dec. 3, 2019 (DE) ..... 102019132850.0

(51) Int. Cl.
*B65D 75/58* (2006.01)
*B65D 85/10* (2006.01)

(52) U.S. Cl.
CPC ... *B65D 75/5838* (2013.01); *B65D 85/10568* (2020.05)

(58) Field of Classification Search
CPC ..... B65D 75/5838; B65D 85/10568
(Continued)

(56) References Cited

U.S. PATENT DOCUMENTS

2005/0252796 A1* 11/2005 Sendo ..... B65D 85/10568 206/242
2008/0093233 A1* 4/2008 Jones ..... B65D 77/042 206/268

(Continued)

FOREIGN PATENT DOCUMENTS

CN 203450510 U 2/2014
DE 102015016456 A1 6/2017

(Continued)

OTHER PUBLICATIONS

WIPO, International Search Report (in a related application), dated Mar. 1, 2021.

(Continued)

*Primary Examiner* — Jacob K Ackun
(74) *Attorney, Agent, or Firm* — Laurence P. Colton; Smith Tempel Blaha LLC

(57) ABSTRACT

A pack for products of the cigarette industry, having an outer pack which is made from a dimensionally stable material and is configured as a flip pack having a box part and a lid, and having at least one cuboid inner pack which is made from a dimensionally stable material, is disposed in the outer pack and encloses the products on all sides, the inner pack having a closure means which prior to the initial use of the inner pack closes a retrieval opening for retrieving individual products which extends at least in an end-side region of the inner pack, preferably additionally extends in a front-side region of the inner pack, and which is able to be converted from the state closing the retrieval opening to a state releasing the retrieval opening, with the closure means being composed of a dimensionally stable material, such as coated cardboard.

17 Claims, 9 Drawing Sheets

(58) Field of Classification Search
USPC ..... 206/268
See application file for complete search history.

(56) References Cited

U.S. PATENT DOCUMENTS

| | | | | |
|---|---|---|---|---|
| 2011/0114518 | A1* | 5/2011 | Hein | B65B 19/20 206/268 |
| 2012/0261286 | A1* | 10/2012 | Holloway | B65D 85/1054 206/268 |
| 2015/0321831 | A1* | 11/2015 | Ghini | B65D 85/10568 206/268 |
| 2017/0327303 | A1* | 11/2017 | Krasiev | B65D 75/5833 |
| 2018/0016089 | A1* | 1/2018 | Polloni | B65D 85/10564 |
| 2019/0002187 | A1 | 1/2019 | Kahawaiolaa | |
| 2019/0106269 | A1 | 4/2019 | Cailleaux | |
| 2019/0185252 | A1* | 6/2019 | Häfker | B65D 85/10568 |
| 2019/0218021 | A1* | 7/2019 | Buse | B65B 61/184 |
| 2019/0225410 | A1* | 7/2019 | Häfker | B65B 19/28 |
| 2020/0115145 | A1* | 4/2020 | Soriano | B65D 75/5838 |

FOREIGN PATENT DOCUMENTS

| | | | |
|---|---|---|---|
| DE | 102016012300 | A1 | 4/2018 |
| GB | 2530269 | A | 3/2016 |
| WO | 02079052 | A1 | 10/2002 |
| WO | 2013046444 | A1 | 4/2013 |
| WO | 2016102461 | A1 | 6/2016 |
| WO | 2016120674 | A1 | 8/2016 |
| WO | 2017072731 | A1 | 5/2017 |
| WO | 2017134565 | A1 | 8/2017 |
| WO | 2018002033 | A1 | 1/2018 |
| WO | 2018130465 | A1 | 7/2018 |
| WO | 2018177814 | A1 | 10/2018 |

OTHER PUBLICATIONS

Deutsches Patent—Und Markenamt (German Patent and Trademark Office), Recherchebericht (search in a relate application), dated Aug. 6, 2020.

European Patent Office, Mitteilung (Observation in a corresponding application), dated Mar. 31, 2023.

* cited by examiner

PACK FOR PRODUCTS OF THE TOBACCO INDUSTRY

CROSS REFERENCE TO RELATED APPLICATIONS

This application is the US National Phase of and claims the benefit of and priority on International Application No. PCT/EP2020/084158 having a filing date of 1 Dec. 2020, which claims priority on and the benefit of German Patent Application No. 10 2019 132 850.0 having a filing date of 3 Dec. 2019.

BACKGROUND OF THE INVENTION

Technical Field

The present invention relates to a pack for products of the cigarette industry, having an outer pack which is made from a blank of a dimensionally stable material and is in particular configured as a flip pack having a box part and a lid, and having at least one in particular cuboid inner pack which is likewise made from a blank of a dimensionally stable material, is disposed in the outer pack and encloses the products on all sides, wherein the inner pack has a closure means which prior to the initial use of the inner pack closes a retrieval opening for retrieving individual products which extends at least in an end-side region of the inner pack, preferably additionally extends in a front-side region of the inner pack, and which closure means is able to be converted from the state closing the retrieval opening to a state releasing the retrieval opening, characterized in that the closure means is composed of a dimensionally stable material, in particular of preferably coated cardboard; to a pack for products of the cigarette industry having an outer pack which is made from a blank of a dimensionally stable material and is in particular configured as a flip pack having a box part and a lid, and having at least two in particular cuboid inner packs which are in each case made from a blank of a dimensionally stable material and are disposed in the outer pack, wherein each inner pack encloses in each case the products on all sides, and wherein each inner pack has a closure means which prior to the initial use of the respective inner pack closes a retrieval opening for retrieving individual products which extends at least in an end-side region of the respective inner pack, preferably additionally extends in a front-side region of the respective inner pack, and which closure means is able to be converted from the state closing the retrieval opening to a state releasing the retrieval opening, wherein the closure means of each inner pack is composed of a dimensionally stable material, in particular of preferably coated cardboard; and to a pack for products of the cigarette industry having an outer pack which is made from a blank of a dimensionally stable material and is in particular configured as a flip pack having a box part and a lid, and having at least one in particular cuboid inner pack which is likewise made from a blank of a dimensionally stable material and is disposed in the outer pack, wherein the inner pack encloses in each case the products on all sides, and wherein the inner pack has at least two closure means which prior to the initial use of the respective inner pack in particular conjointly close a retrieval opening for retrieving individual products which extends at least in an end-side region of the respective inner pack, preferably additionally extends in a front-side region of the respective inner pack, wherein each closure means is able to be converted from the state closing the retrieval opening to a state (at least in regions) releasing the retrieval opening, wherein each closure means of the inner pack is composed of a dimensionally stable material, in particular of preferably coated cardboard.

Prior Art

Packs for products of the cigarette industry are known in which a dimensionally stable inner pack which in the closed state surrounds the products on all sides is contained in a dimensionally stable outer pack (box-in-box), in particular as flip pack having lid and box part. It is known herein for a retrieval opening of the dimensionally stable inner pack to be closed by a repeatedly effective closure label of foil that is movable between a position closing the retrieval opening to a position releasing the retrieval opening (and vice versa). The application of these closure labels to the inner packs by a machine is complex, cost-intensive, and prone to errors, in particular with a view to the closure labels being attached in the correct position.

BRIEF SUMMARY OF THE INVENTION

It is an object of the present invention to refine the above-mentioned packs.

This object is achieved by a pack having the features of the claims.

A pack for products of the cigarette industry having the features of the present invention accordingly has an outer pack which is made from a blank of a dimensionally stable material and is in particular configured as a flip pack having a box part and a lid, and has at least one in particular cuboid inner pack which is likewise made from a blank of a dimensionally stable material, is disposed in the outer pack and encloses the products on all sides (in the closed state of the inner pack). The inner pack herein furthermore has a closure means which prior to the initial use of the inner pack closes a retrieval opening for retrieving individual products which extends at least in an end-side region of the inner pack, preferably additionally extends in a front-side region of the inner pack, and which closure means is able to be converted from the state closing the retrieval opening to a state releasing the retrieval opening. This closure means according to the invention herein is composed of a dimensionally stable material.

This dimensionally stable material can be cardboard, for example. The cardboard is preferably coated, for example with a layer which has an aroma or moisture barrier. This however is not mandatory.

As for its fundamental construction, the/each inner pack in the context of this application can possess a large-area front wall, a large-area rear wall which lies opposite the front wall, two mutually spaced apart narrow-side walls which connect the front wall and the rear wall to one another, a base wall, as well as an end wall which lies opposite the base wall and is parallel to the latter.

The closure means can preferably be a pivotably mounted closure tab which is in particular integrally connected to the inner pack and is pivotable from the state closing the retrieval opening, specifically a closing position, to the state releasing the retrieval opening, specifically an opening position.

The closure tab herein can be pivotably mounted by means of a linear articulation which is formed by a fold line which connects the rear wall and the end wall of the inner pack to one another, or which is formed by a fold line which is part of the end wall of the inner pack and runs at a spacing from the inner pack edge that connects the rear wall and the end wall of the inner pack to one another.

An end-side portion of the closure tab can preferably be formed by the end wall of the inner pack, in particular by the entire end wall or by a segment of the latter, and/or a front-side portion of the closure tab can be formed by a segment of the front wall of the inner pack.

Furthermore preferably, the end-side portion and/or the front-side portion of the closure tab prior to the initial use of the inner pack, by way of one or a plurality of tear-open lines, in particular from perforations or scorings, can be connected either to adjacent narrow-side walls of the inner pack or to one or a plurality of adjacent segments of the end wall, or of the front wall, respectively, of the inner pack.

The retrieval opening in the full length defined by the spacing of two parallel upright narrow-side walls of the inner pack can herein be covered by the end-side portion of the closure tab that is formed by the end wall of the inner pack.

The end-side portion of the closure tab prior to the initial use of the inner pack can herein bear so as to be unconnected on free (upper) edges of the narrow-side walls.

The front-side portion of the closure tab in the closing position of the inner pack in regions can bear externally on the front wall of the inner pack, in particular be fastened to the latter by means of a releasable, preferably repeatedly effective, adhesive.

As for the front-side portion of the closure tab, said front-side portion in the closing position can completely cover a portion, or the portion, respectively, of the retrieval opening that extends in the front-side region of the inner pack.

The front-side portion of the closure tab can cover a (lateral) peripheral region of the front wall of the inner pack, the portion of the retrieval opening that extends in the front-side region of the inner pack being adjacent to said (lateral) peripheral region.

Free edges, created after the initial use of the inner pack, of that front-side portion of the closure tab which is formed by the segment of the front wall of the inner pack and/or free edges, created after the initial use of the inner pack, of that end-side portion of the closure tab which is formed by the segment of the end wall or by the entire end wall in the closing position of the closure tab can lie seamlessly, or substantially seamlessly, opposite assigned free edges of the inner pack that are adjacent to the retrieval opening, or delimit the latter, respectively, in particular free edges of the adjacent segment of the front wall and/or of the adjacent segment of the end wall and/or of the entire end wall of the inner pack.

The front-side portion and/or the end-side portion of the closure tab in the closing position of the closure tab herein can extend in the same plane as the respectively adjacent segment of the front wall or of the end wall, respectively, of the inner pack.

The closure tab can have a preferably end-side connection portion which is in particular integrally connected to said closure tab by way of a fold line and which, in particular by means of an adhesive, is permanently fastened to the lid of the outer pack such that the closure tab when opening the lid is automatically pivoted from the closing position of said closure tab to the opening position of said closure tab.

The connection portion of the closure tab can preferably be connected to the internal side of a lid front wall, or to an activation flap of the lid that is in particular configured as a lid inner flap and is pivotable relative to a wall of the lid, in particular the lid front wall, preferably by means of an adhesive, in particular in such a manner that the closure tab when opening the lid, with the participation of a pivoting movement of the activation flap, is automatically movable relative to the wall of the lid to an opening position.

The activation flap herein can be pivotable relative to the lid front wall about a linear articulation which is formed by a fold line by way of which the lid front wall is (integrally) connected to the activation flap.

The afore-mentioned connection portion of the closure tab and the activation flap of the lid can be configured and connected to one another in such a manner that the activation flap, when opening the lid, by virtue of the pivoting movement is movable along the linear articulation first to a preferably acute initial position, and thereafter, under a continuing pivoting movement, to a transverse position, and finally to a stretched position, or to an obtuse position relative to the lid front wall, while in each case entraining the closure tab.

The activation flap of the lid can have a further linear articulation formed by a fold line between the first linear articulation formed by the fold line and a (free) end edge of the activation flap that is in particular parallel to the fold line, wherein the fold line of the further linear articulation runs so as to be parallel to and spaced apart from the fold line of the first linear articulation.

The connection flap of the closure tab can be connected to the activation flap, or fastened to the latter, respectively, exclusively on a connection portion of said activation flap that is delimited by the second linear articulation, on the one hand, and by the end edge of the activation flap, on the other hand, and in the case of an opened lid can cover the activation flap exclusively in this connection portion.

The closure tab, in particular outside the connection flap, can have a plurality of, preferably more than two, weakening lines that run (preferably parallel) at a mutual spacing, are in particular configured as grooves, scorings or perforations and delimit individual closure tab portions which are movable, in particular pivotable, relative to one another about the weakening lines.

As for the closure means, alternatively to the embodiment as a closure tab, said closure means can also be a closure piece which prior to the initial use of the inner pack is in particular integrally connected to the inner pack and in the initial use of the inner pack is able to be completely separated from the inner pack along one or a plurality of tear-open lines, in particular of perforations or scorings, such that the closure piece can be completely removed from the inner pack.

An end-side portion of the closure piece herein can be formed by the end wall of the inner pack, in particular by the entire end wall or a segment of the latter, and/or a front-side portion of the closure piece can be formed by a segment of the front wall of the inner pack.

The closure piece prior to the initial use of the inner pack by way of the or each tear-open line, in particular of perforations or scorings, can be connected to one or a plurality of adjacent segments of the end wall and/or of the front wall of the inner pack.

The closure piece prior to the initial use of the inner pack by way of a contiguous peripheral piece, or a contiguous peripheral strip, respectively, of the inner pack that extends across the front wall and the end wall of the inner pack can also be spaced apart from those external edges of the inner pack that are (co-) defined by the front wall and the end wall of the inner pack and lie opposite the peripheries of the closure piece.

The closure piece prior to the initial use of the inner pack herein can extend in the same plane as the adjacent peripheral piece, or the adjacent peripheral strip, respectively.

An indentation tab, which is in particular delimited by one or a plurality of incisions or delimited by one or a plurality of tear-open lines, is adjacent to the closure piece and for facilitating the separation of the closure piece from the inner pack is able to be indented inwards by a user in the direction of the interior of the inner pack, can preferably be formed in the front wall and/or the end wall of the inner pack.

The closure piece can be connected to the internal side of a lid front wall and/or of a lid end wall of the outer pack or to an activation flap of the lid that is in particular configured as a lid inner flap and is pivotable relative to a wall of the lid, in particular the lid front wall, preferably by means of an adhesive. This can in particular be in such a manner that the closure piece when opening the lid is automatically completely separated from the inner pack, preferably with the participation of a pivoting movement of the activation flap relative to the wall of the lid.

The closure means can preferably be a component part, connected integrally thereto, of the blank from which the inner pack is made.

A pack for products of the cigarette industry having the features of the present invention alternatively has an outer pack which is made from a blank of a dimensionally stable material and is in particular configured as a flip pack having a box part and a lid, and has at least two in particular cuboid inner packs which are in each case made from a blank of a dimensionally stable material and are disposed in the outer pack, wherein each inner pack encloses in each case the products on all sides, and wherein each inner pack has a closure means which prior to the initial use of the respective inner pack closes a retrieval opening for retrieving individual products which extends at least in the end-side region of the respective inner pack, preferably additionally extends in the front-side region of the respective inner pack, and which closure means is able to be converted from the state closing the retrieval opening to a state releasing the retrieval opening. According to the invention, the closure means of each inner pack herein is then composed of a dimensionally stable material, in particular of the preferably coated cardboard.

In the case of this solution, each inner pack can have in each case a dedicated closure means which is separated or different, respectively, from the respectively other closure means of the respectively other inner pack.

It is understood that, independently thereof, each inner pack and/or each closure means and/or the outer pack can be configured, or can have one or a plurality of features of the inner pack and/or of the closure means and/or of the outer pack, as has been described in detail above in the context of the outer pack in which the (at least) one inner pack is contained.

Therefore, each closure means can be configured as a closure tab, for example, which is configured as described above. However, it is also conceivable that each closure means is configured as a closure piece as described above.

In particular, a or each closure tab can have in each case a preferably end-side connection portion, as described above, which is connected by way of a fold line and, in particular by means of an adhesive, is permanently fastened to the lid of the outer pack such that the closure tab when opening the lid is automatically pivoted from the closing position of said closure tab to the opening position of said closure tab.

It can be provided herein that (only) the closure tab of the one inner pack is fastened to the lid of the outer pack, and that the closure tab of the other inner pack is not fastened to the lid of the outer pack. However, it is also conceivable for none of the closure tabs or both of the closure tabs to be fastened to the lid.

A pack for products of the cigarette industry having the features of the present invention alternatively has an outer pack which is made from a blank of a dimensionally stable material and is in particular configured as a flip pack having a box part and a lid, and has at least one in particular cuboid inner pack which is likewise made from a blank of a dimensionally stable material and is disposed in the outer pack, wherein the inner pack encloses in each case the products on all sides, and wherein the inner pack has at least two closure means which prior to the initial use of the respective inner pack in particular conjointly close a retrieval opening for retrieving individual products which extends at least in the end-side region of the respective inner pack, preferably additionally extends in the front-side region of the respective inner pack, wherein each closure means is able to be converted from the state closing the retrieval opening to a state (at least in regions) releasing the retrieval opening. In the case of this solution according to the invention, each closure means of the inner pack is composed of a dimensionally stable material, in particular of preferably coated cardboard.

It is also understood here that the inner pack and/or each closure means and/or the outer pack can be configured such, or can have one or a plurality of features of the inner pack and/or of the closure means and/or of the outer pack, respectively, as has been described in detail above in the context of the outer pack, in which the (at least) one inner pack is contained.

Therefore, each closure means can be configured as a closure tab, for example, which is configured as described above. However, it is also conceivable for each closure means to be configured as a closure piece as described above.

For example, a or each closure tab of the inner pack can have a preferably end-side connection portion which is connected by way of a fold line and, in particular by means of an adhesive, is permanently fastened to the lid of the outer pack such that the closure tab when opening the lid is automatically pivoted from the closing position of said closure tab to the opening position of said closure tab.

Only the one closure tab of the inner pack herein can also be fastened to the lid of the outer pack, and the other closure tab of the inner pack is not fastened to said lid.

However, it is also conceivable for the two closure tabs to not be connected to the inner pack.

Furthermore, an end-side portion of each closure tab, as described above, can be formed by in each case one segment of the end wall of the inner pack, and/or a front-side portion of each closure tab can be formed by one segment of the front wall of the inner pack, for example.

As for the retrieval opening of the inner pack, said retrieval opening of the inner pack in the full length defined by the spacing of two parallel upright narrow-side walls of the inner pack can be covered conjointly by the two closure tabs (which are in particular disposed beside one another and are mutually adjacent on one side).

The two closure tabs, in particular the two front-side portions of the closure tabs, prior to the initial use of the inner pack can also be connected to one another by way of one or a plurality of tear-open lines, in particular of perforations or scorings, a separation of the two closure tabs from one another taking place or being able to take place along said tear-open lines during the initial use of the pack.

BRIEF DESCRIPTION OF THE DRAWINGS

Further features of the present invention are derived from the appended patent claims, the description hereunder of preferred exemplary embodiments and the appended drawings, in which:

DETAILED DESCRIPTION OF PREFERRED EMBODIMENTS

Figure 2:
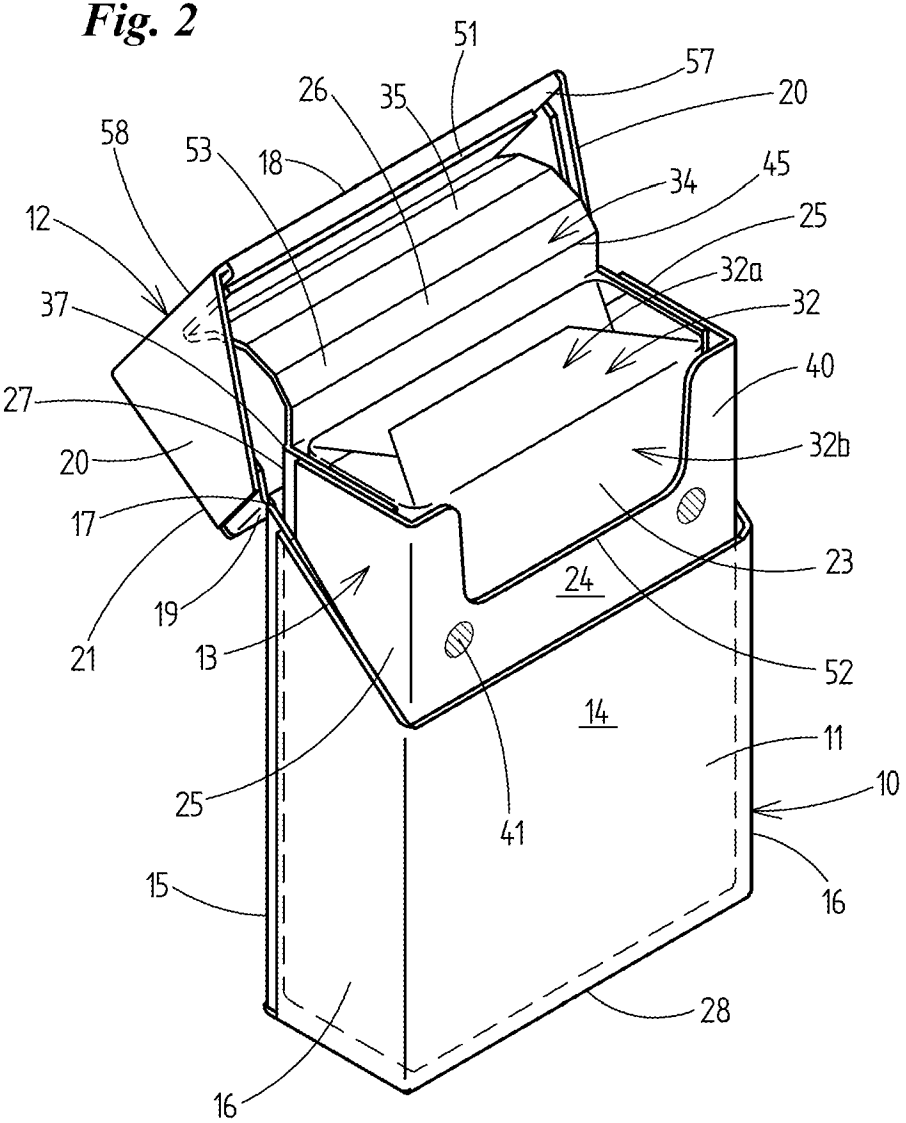
FIG. 2 shows the inner pack from FIG. 1 disposed in an outer pack of the pack according to the invention, with the lid opened, in a perspective view.

The exemplary packs reproduced in the drawings relate to cigarette packs of the hinge-lid or flip pack type, respectively, designed as a box-in-box pack.

Features which are common to all embodiments of FIGS. 1-17 will be described first hereunder. The specifications of the individual embodiments will be separately discussed thereafter.

The afore-mentioned packs conventionally possess an outer pack 10 having a lower (cup-shaped) box part 11 and a lid 12. The invention is however not limited to such outer packs. Outer packs without a lid or a pivotable lid, respectively, are also conceivable, for example.

The box part 11 and the lid 12 of the outer pack 10 are preferably made from a common blank of a dimensionally stable material, in particular (thin and optionally coated) cardboard.

At least one inner pack 13 is in each case disposed in the outer pack 10, is likewise typically cuboid and likewise preferably made from a blank of a dimensionally stable material such as (thin and optionally coated) cardboard.

The dimensionally stable material is preferably configured so as to have an aroma and/or a moisture barrier. It is understood that this is not mandatory.

The box part 11 of the respective outer pack 10 has a large-area box part front wall 14, a large-area (opposite) box part rear wall 15, two narrow upright box part narrow-side walls 16 which in each case connect the box part front wall 14 and the box part rear wall 15 to one another, as well as a box part base wall 28.

The lid 12 is articulated on the box part rear wall 15 by way of a linear articulation 17 and has a lid front wall 18, a lid rear wall 19, two lid lateral walls 20 which in each case connect the lid front wall 18 and the lid rear wall 19 to one another, as well as a lid end wall 21 which in the closed state of the outer pack 10 lies opposite the box part base wall 28 in parallel planes.

At least one cigarette group or a cigarette formation 22, respectively, is situated in the respective inner pack 13.

As in the embodiment of FIG. 2, said cigarette group can additionally be sheathed by an internal sheathing 23 produced from a blank of silver paper or thin paper or the like, but this is not mandatory.

The inner pack 13 possesses an inner front wall 24 which faces the box part front wall 14, inner narrow-side walls 25 which in each case face the respective box part narrow-side walls 16, an inner end wall 26 which in the closed state of the pack faces the lid end wall 21, an inner rear wall 27 which faces the box part rear wall 15, as well as an inner base wall 29 which faces the box part base wall 28.

The inner narrow-side walls 25 presently are in each case configured in two tiers, in each case from internal inner lateral flaps 30 and external inner lateral flaps 31.

The inner packs 13 of all of the exemplary embodiments have in each case at least one retrieval opening 32 by way of which cigarettes of the respective cigarette group 22 can be retrieved.

The retrieval openings 32 herein extend in each case by way of an end-side region 32*a* partially or completely in the region of the inner end wall 26 of the inner pack 13, and extend by way of a front-side region 32*b* (partially) in the region of the adjacent inner front wall 24, wherein the front-side region 32*b* adjoins the end-side region 32*a*.

A common feature of all exemplary embodiments is moreover that the respective retrieval opening 32 possesses at least one closure means 34 which presently is integrally connected to the respective blank 33 from which the respective inner pack 13 is made and which, prior to the initial use of the inner pack 13 by a user of the pack, is in a state closing the respective retrieval opening 32 either in regions or completely.

The respective closure means 34 is composed of a dimensionally stable material having in particular (but not mandatorily) an aroma or moisture barrier, for example likewise of (thin and optionally coated) cardboard.

When the closure means 34 as described above is integrally connected to the respective blank 33, or is a component part thereof, respectively, said closure means 34 is correspondingly made from the same dimensionally stable material as the respective inner pack 13 made from the blank 33.

The closure means 34 in the initial use of the pack, or of the inner pack 13, respectively, by a user of the pack can then be converted from the state closing the retrieval opening 32 to a state releasing the retrieval opening 32 at least in regions or completely. In some of the exemplary embodiments the closure means 34 can also be returned to the closing state again.

Figure 1:
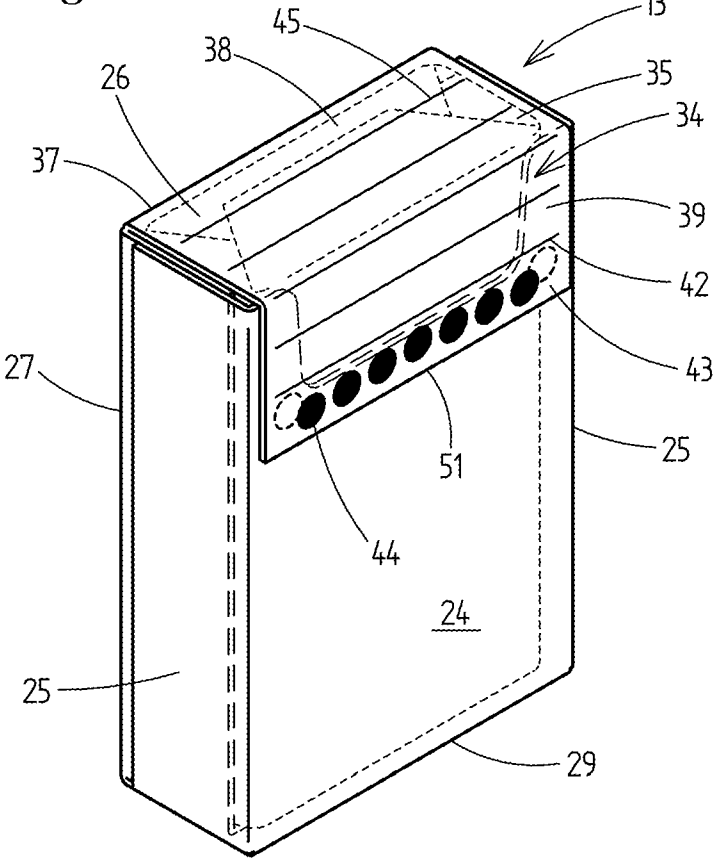
FIG. 1 shows an inner pack of a first embodiment of a pack according to the invention, in a perspective view.

Exemplary Embodiment of FIGS. 1 and 2

Figure 4:
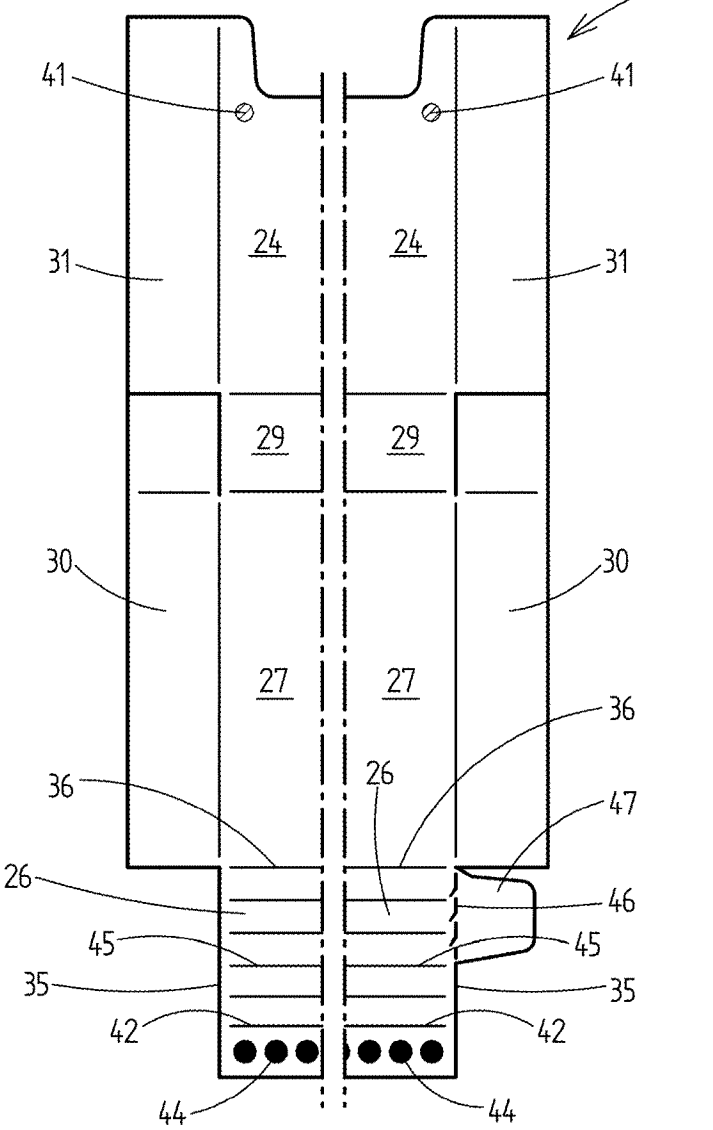
FIG. 4 shows a plan view of a blank for the production of the inner pack according to FIG. 1/FIG. 2 (left half of blank) or the inner pack according to FIG. 3 (right half of blank)

In the exemplary embodiment of FIGS. 1 and 2 and 4, respectively, (left half of blank), the afore-mentioned conversion to the state releasing the retrieval opening, in particular but not only in the initial use of the pack, takes place automatically when opening the lid 12 of the outer pack 10 by a user, since the closure means 34 is fastened to the lid 12 and when pivoting the lid 12 about the linear articulation 17 is moved from a closing position in which the retrieval opening 32 is closed to an opening position in which the retrieval opening 32 is released. The closure means 34 can be returned or moved back, respectively, to the closing position by way of an opposite movement of the lid 12.

It is understood that it can also be provided that the closure means 34 is not fastened to the lid 12 such that a user would/would have to manually grip the closure means 34 and move the latter to the opening position and optionally to the closing position, respectively. It is stressed that this applies to all equivalent embodiments of the present application.

In this exemplary embodiment, the retrieval opening 32 extends by way of the end-side region 32*a* thereof across the full depth of the inner pack 13, said depth being defined by the spacing between the inner front wall 24 and the opposite inner rear wall 27.

Furthermore, the retrieval opening 32 extends by way of the end-side region 32*a* thereof across the full width of the inner pack 13, said width being defined by the spacing between the one inner narrow-side wall 25 and the other, opposite, parallel inner narrow-side wall 25.

In contrast, that front-side region 32*b* of the retrieval opening 32 which adjoins the end-side region 32*a* is embodied so as to be reduced in relation to the width of the inner pack 13, or the inner front wall 24, respectively, and presently is placed so as to be approximately centric in terms of the transverse extent of the inner front wall 24.

An encircling, presently U-shaped, peripheral strip or peripheral portion 40 of the inner front wall 24 herein surrounds the front-side region 32*b* of the retrieval opening 32, or delimits the latter, respectively.

The closure means 34 of the inner pack 13 in the embodiment of FIGS. 1 and 2 is configured as a closure tab 35 which is integrally connected to the blank 33 shown in FIG. 4.

The closure tab 35 presently is connected to the inner rear wall 27 of the inner pack 13 by way of a fold line 36. The fold line 36 forms a linear articulation 37 about which the closure tab 35 is pivotable (from the closing position to the opening position).

The closure tab 35 possesses an end-side portion 38 which is formed by the entire inner end wall 26 of the inner pack 13.

The end-side portion 38 completely covers the retrieval opening 32 and in the present case extends across the entire width of the inner pack 13, or of the retrieval opening 32, respectively, specifically from the one inner narrow-side wall 25 to the other, opposite, parallel inner narrow-side wall 25, as well as across the entire depth, thus from the inner front wall 24 up to the opposite inner rear wall 27.

In the closed position of the closure tab 35, the end-side portion 38 by way of the lateral peripheries thereof bears on the two upper edges of the inner narrow-side walls 25, or is supported by the latter, respectively.

The closure tab 35 furthermore possesses a front-side portion 39 which in the closed position of the closure tab 35 covers the front-side region 32*b* of the retrieval opening 32 above the retrieval opening plane and which additionally covers (at least in regions) that peripheral region 40 of the inner front wall 24 which surrounds the front-end region 32*b* of the retrieval opening 32, said peripheral region 40 being adjacent to the front-side region 32*b* of the retrieval opening 32.

The front-side portion 39 of the closure tab 35, in particular for manufacturing purposes, by way of one or a plurality of repeatedly effective releasable adhesive areas 41, presently adhesive spots, is releasably fastened to the inner front wall 24.

As has already been indicated above, the closure tab 35 is furthermore fixedly connected to the lid 12, or fastened to the latter, respectively.

In that the closure tab 35 presently has an end-side connection portion 43 which by way of a fold line 42 is integrally connected to said closure tab 35 and by means of adhesive areas 44 is permanently connected to the internal side of the lid front wall 18 such that the closure tab 35 when opening the lid 12 is entrained and automatically pivoted from the closing position of said closure tab 35 to the opening position of said closure tab 35.

The lid front wall 18 at least in regions is presently formed in two tiers from a lid outer flap 58 and a lid inner flap 57 which is fixedly connected or adhesively bonded, respectively, to the latter, wherein the closure tab 35, specifically an end-side connection portion 43 thereof, is adhesively bonded to the internal side of the lid inner flap 57. It is understood that the lid front wall 18 does not mandatorily have to be configured with two tiers.

In order to impart the dimensionally stable material of the closure tab 35 a certain flexibility, on account of which the conversion of the closure tab to the opening position thereof (and vice versa) is facilitated, a plurality of weakening lines 45, for example as grooves, scorings or perforations, that run mutually parallel are disposed on the internal side of the closure tab 35, or integrated (in the internal side) in the closure tab 35. The weakening lines 45 can but do not have to in each case preferably extend across the entire width of the closure tab 35.

Figure 3:
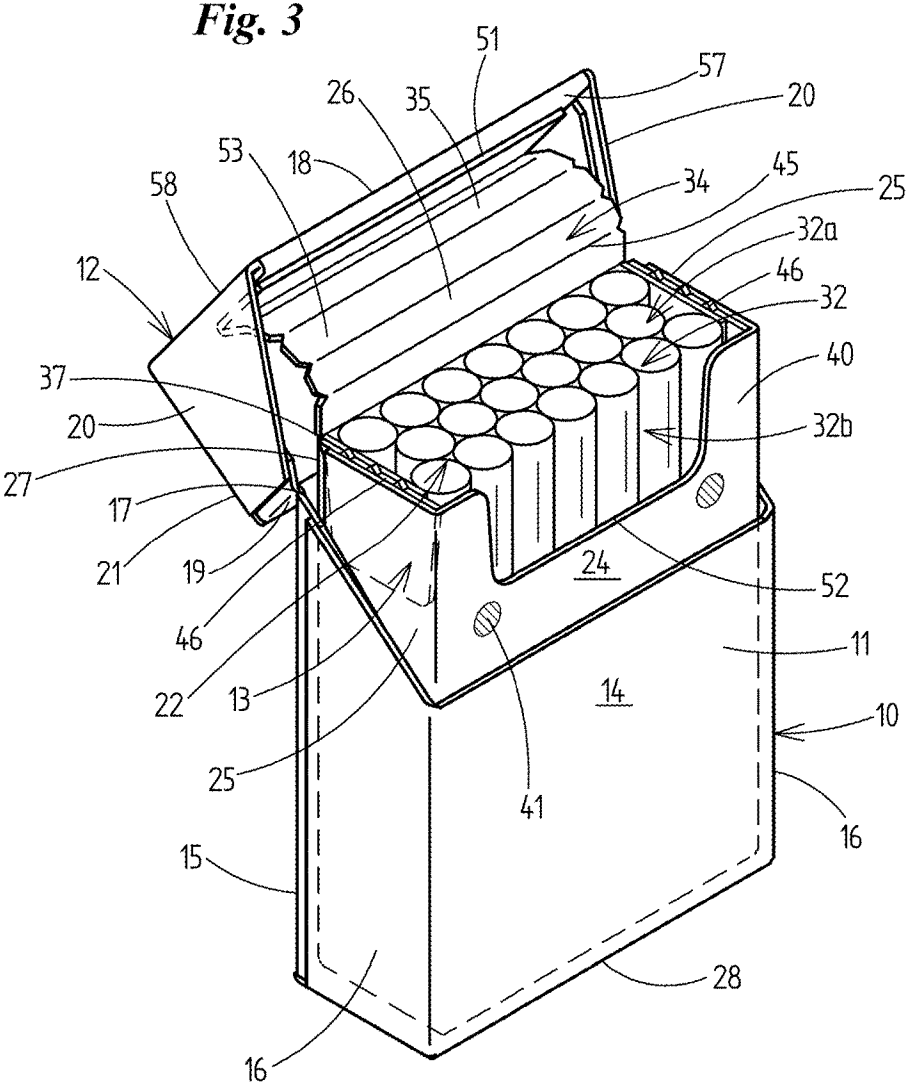
FIG. 3 shows a second embodiment of a pack according to the invention, in an illustration analogous to that of FIG. 2, in a perspective view.

Exemplary Embodiment of FIG. 3

The points of differentiation of the embodiment of FIGS. 3 and 4 (right half of blank) in comparison to the embodiment of FIGS. 1 and 2 will be substantially described hereunder. The features not described correspond to those of the embodiment of FIG. 2.

As opposed to the embodiment of FIG. 2, the end-side portion 38 of the closure tab 35 of the embodiment of FIG. 3 does not bear so as to be unconnected on the upper edges of the inner narrow-side walls 25, but the end-side portion 38 prior to the initial use of the inner pack 13 is releasably connected to said edges by way of tear-open lines 36.

More specifically, each inner narrow-side wall 25, presently in each case one corner side flap 47, which is connected or adhesively bonded to the respective internal inner side flap 30 of the respective inner narrow-side wall 25, is connected to the end-side portion 38 of the closure tab 35, or lateral peripheries of the latter, respectively, by way of in each case one tear-open line 46.

In the initial use of the inner pack 13, or when initially opening the outer pack 10 by pivoting the lid 12, respectively, the front-side portion 39 of the closure tab 35 is then initially lifted from the inner front wall 24 and, when the pivoting movement of the lid 12 continues, the separation of the end-side portion 38 from the inner narrow-side walls 25, or the tearing-open of the end-side portion 38 of the closure tab 35 in the end-side region 32*a* of the retrieval opening 32 respectively, then takes place.

The tear-open lines 46 can be composed of perforations or grooves, for example.

Figure 6:
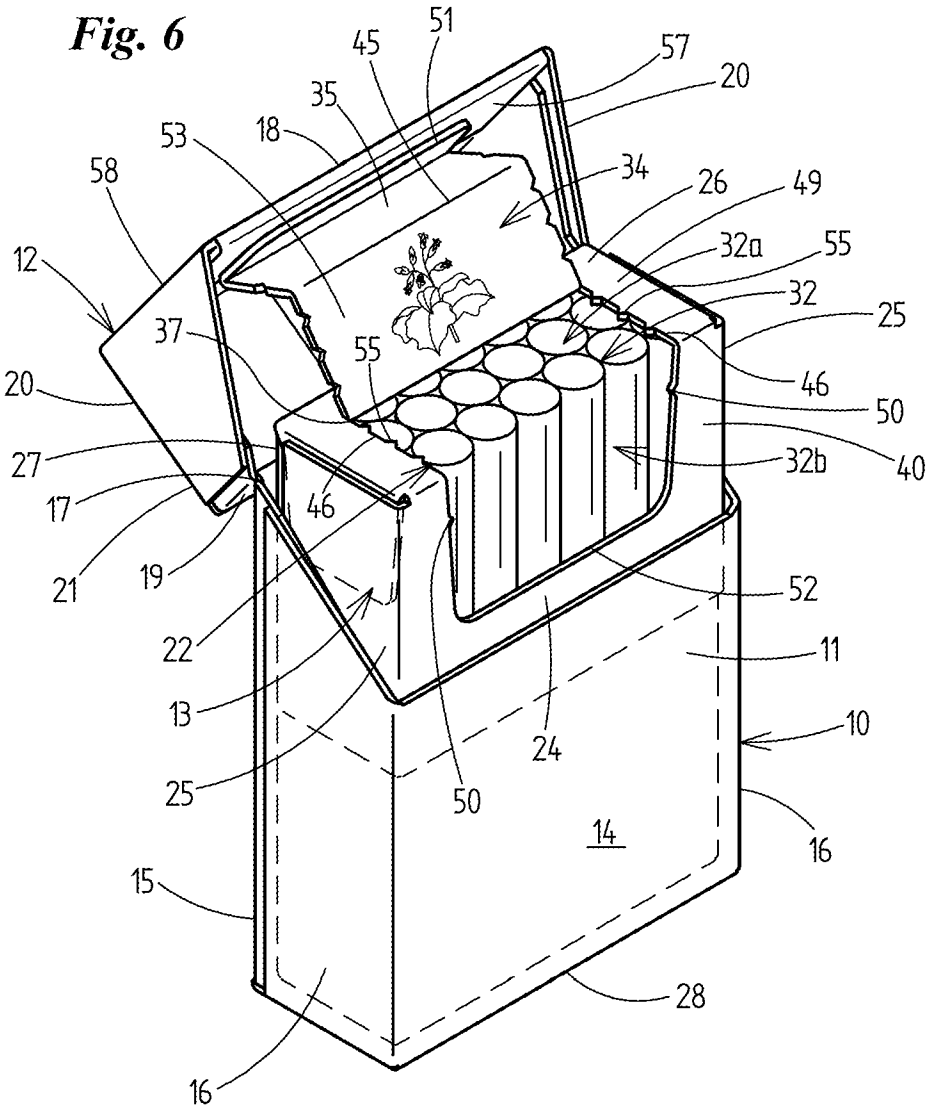
FIG. 6 shows the inner pack from FIG. 5 disposed in an outer pack of the pack according to the invention, with the lid opened, in a perspective view.
Figure 5:
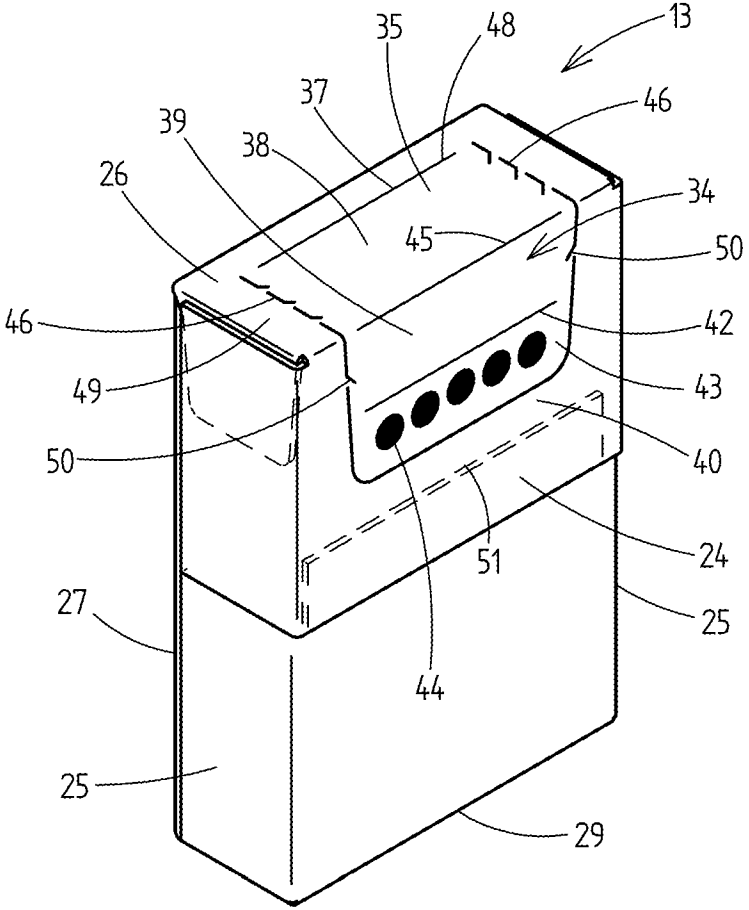
FIG. 5 shows an inner pack of a third embodiment of a pack according to the invention, in a perspective view.

Exemplary Embodiment of FIGS. 5 and 6

Figure 8:
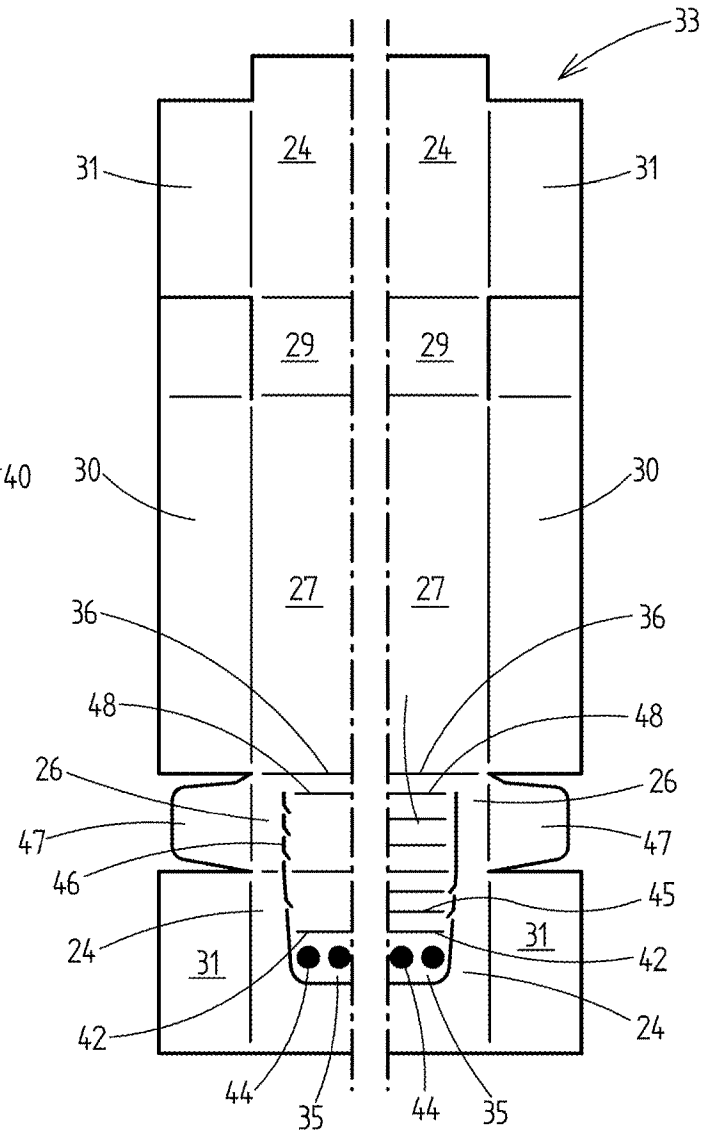
FIG. 8 shows a plan view of a blank for the production of the inner pack according to FIGS. 5/6 (left half of blank) or FIG. 7 (right half of blank)

A further embodiment of a pack according to the invention is shown in FIGS. 5 and 6 or 8 (left half of blank). The points of differentiation of this embodiment in comparison to the embodiment of FIG. 3 will be substantially described hereunder. The features which are not described or are not different correspond to those of the embodiment of FIG. 3.

As opposed to the inner pack 13 of FIG. 3, the end-side region 32*a* of the retrieval opening 32 of the inner pack 13 of FIGS. 5, 6 does not extend across the full width of the inner pack 13 or of the inner front wall 24, respectively, but is reduced in relation to said width.

Accordingly, the end-side portion 38 of the closure tab 35 is not formed by the entire inner end wall 26 of the inner pack 13 but only by a segment of the latter.

Accordingly, the lateral peripheries of the end-side portion 38 of the closure tab 35 are in each case spaced apart from the upper edges of the inner narrow-side walls 25.

Furthermore, the linear articulation 37 about which the closure tab 35 is pivotable, is not formed by the fold line 36 which connects the inner end wall 26 and the inner rear wall 27 to one another, but by a further fold line 48 which is parallel to said fold line 36 and spaced apart from the latter.

Consequently, prior to the initial use of the inner pack 13, an in particular U-shaped peripheral region 49 of the inner end wall 26 delimits or surrounds, respectively, the end-side portion 38 of the closure tab 35 and in the opening position of the closure tab 35 delimits the end-side region 32*a* of the retrieval opening 32.

In the initial use of the inner pack 13, the end-side portion 38 of the closure tab 35 that is at least in regions preferably releasably connected to the peripheral region 49 of the inner end wall 26 is pivoted about the linear articulation 37 upward out of the plane of the adjacent peripheral region 49.

In the further point of differentiation to the embodiment of FIG. 3, the front-side portion 39 does not cover the peripheral region 40 of the inner front wall 24. Furthermore, the front-side portion 39 does not cover the front-side region 32*b* of the retrieval opening 32 above the assigned retrieval opening plane, but extends directly in the retrieval opening plane.

This takes place in that the front-side portion 39 of the closure tab 35 of the inner pack 13 presently is formed directly by a segment of the inner front wall 24 of the inner pack 13, said segment prior to the initial use of the inner pack 13, or in a closing position of the closure tab 35, respectively, accordingly being surrounded by the remaining part of the inner front wall 24, or by the peripheral region 40 of the inner front wall 24, respectively, in the same plane.

Consequently, prior to the initial use of the inner pack 13, the in particular U-shaped peripheral region 40 of the inner front wall 24 delimits or surrounds, respectively, the front-side portion 39 of the closure tab 35 and in the opening position of the closure tab 35 delimits the front-side region 32*b* of the retrieval opening 32.

This can be particularly readily seen in FIG. 5 which shows the inner pack 13 prior to the initial use of the latter.

In summary, the closure tab 35 overall is formed by the inner end wall 26 (a segment of the latter) and the inner front wall 24 (a segment of the latter) of the inner pack 13.

The closure tab 35 prior to the initial use of the inner pack 13 herein is partially releasably connected to the adjacent segments or peripheries 49 or 40, respectively, of the inner end wall 26 or of the inner front wall 24, respectively; free edges of the closure tab 35 partially lie substantially seamlessly opposite, but so as to be unconnected to, corresponding edges of the segments of the inner end wall 26 or of the inner front wall 24, respectively, that surround the retrieval opening 32.

Specifically, the end-side portion 38 of the closure tab 35, prior to the initial use of the inner pack 13, presently is correspondingly connected at two opposite sides to the peripheral region 49 of the inner end wall 26 by way of parallel tear-open lines 46, in particular to the opposite edges 55 of the peripheral region 49 that in each case are adjacent to the end-side region 32*a* of the retrieval opening 32.

The front-side portion 39 of the closure tab 35 prior to the initial use of the inner pack 13 is also releasably connected to the corresponding segment of the inner front wall 24 or to the peripheral region 40 at two opposite sides, specifically by way of (short) remaining connections 50.

At least one (lower) edge 51 of the connection portion 43 of the closure tab 35 preferably lies opposite in an unconnected manner the corresponding edge 52 of the peripheral region 40 of the inner front wall 24 that delimits the front-side region 32*b* of the retrieval opening 32, so as to facilitate the opening or tearing-open, respectively, of the closure tab 35 in the initial opening of the lid 12.

In the further point of differentiation to the pack of FIG. 3, the end-side portion 38 of the closure tab 35 is provided not with a plurality of weakening lines 45 but only one weakening line 45. Specifically with a weakening line 45 which forms the fold line about which the blank 33 during manufacturing of the inner pack 13 is folded for forming the pack edge that connects the inner front wall 18 to the inner end wall 26.

By dispensing with the further weakening lines 45, the internal side 53 of the end-side portion 38 of the closure tab 35 that in the closing position of the closure tab 35 is oriented towards the interior of the inner pack 13 is able to be provided, in particular printed, in a particularly simple manner with a readily visible image object or a text, said image object or text then being able to be seen by a user of the inner pack in the opening position of the closure tab 45.

Figure 7:
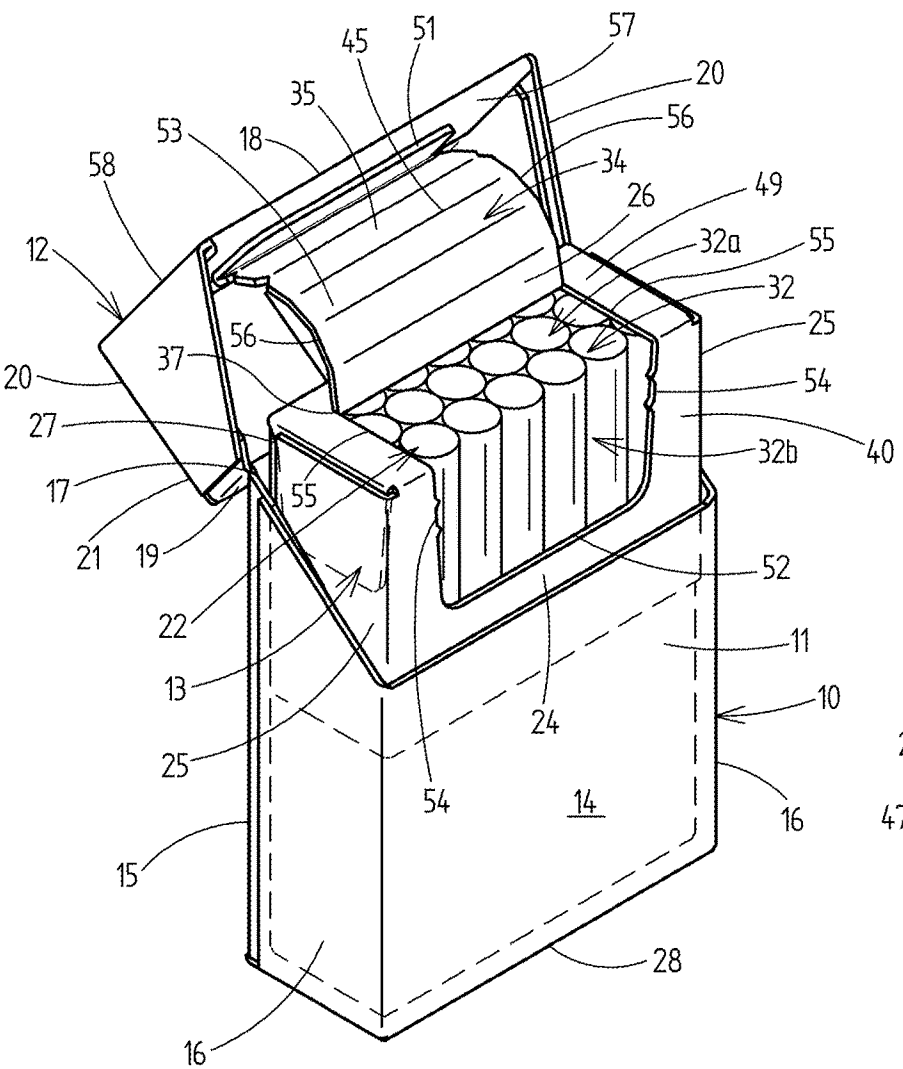
FIG. 7 shows a fourth embodiment of a pack according to the invention in an illustration analogous to that of FIG. 6.

Exemplary Embodiment of FIG. 7

A further embodiment of a pack according to the invention is shown in FIGS. 7 and 8, respectively, (right half of blank). The points of differentiation of this embodiment to the embodiment of FIGS. 5 and 6 will be substantially described hereunder. The features which are not described correspond to those of the embodiment of FIGS. 5 and 6.

In the point of differentiation to the pack of FIGS. 5 and 6, the end-side portion 38 of the closure tab 35 of the inner pack 13 prior to the initial use of the inner pack 13 of the pack at the two opposite sides is not releasably connected to the peripheral region 49 of the inner end wall 26, in particular not to the opposite edges 55 of the peripheral region that in the open state of the closure tab 35 are in each case adjacent to the end-side region 32*a* of the retrieval opening 32. Rather, corresponding free edges 56 of the end-side portion 38 of the closure tab 35 prior to the initial use of the inner pack 13 lie opposite these edges 55 of the peripheral region 49 in an unconnected manner.

In contrast, the front-side portion 39 of the closure tab 35 prior to the initial use of the inner pack 13 at the two opposite sides is connected to the corresponding segment of the inner front wall 24, or to the peripheral region 40, respectively, not only by way of (short) remaining connections 50 but by way of (longer) tear-open lines 54.

Figure 10:
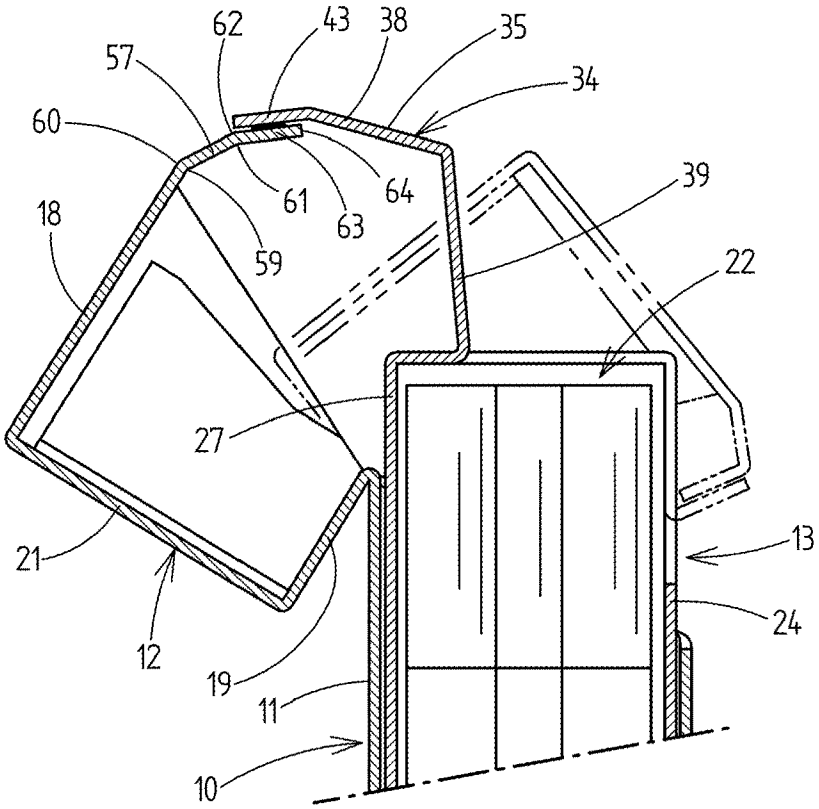
FIG. 10 shows a section through the pack in FIG. 9 along the section plane X-X in FIG. 9.
Figure 9:
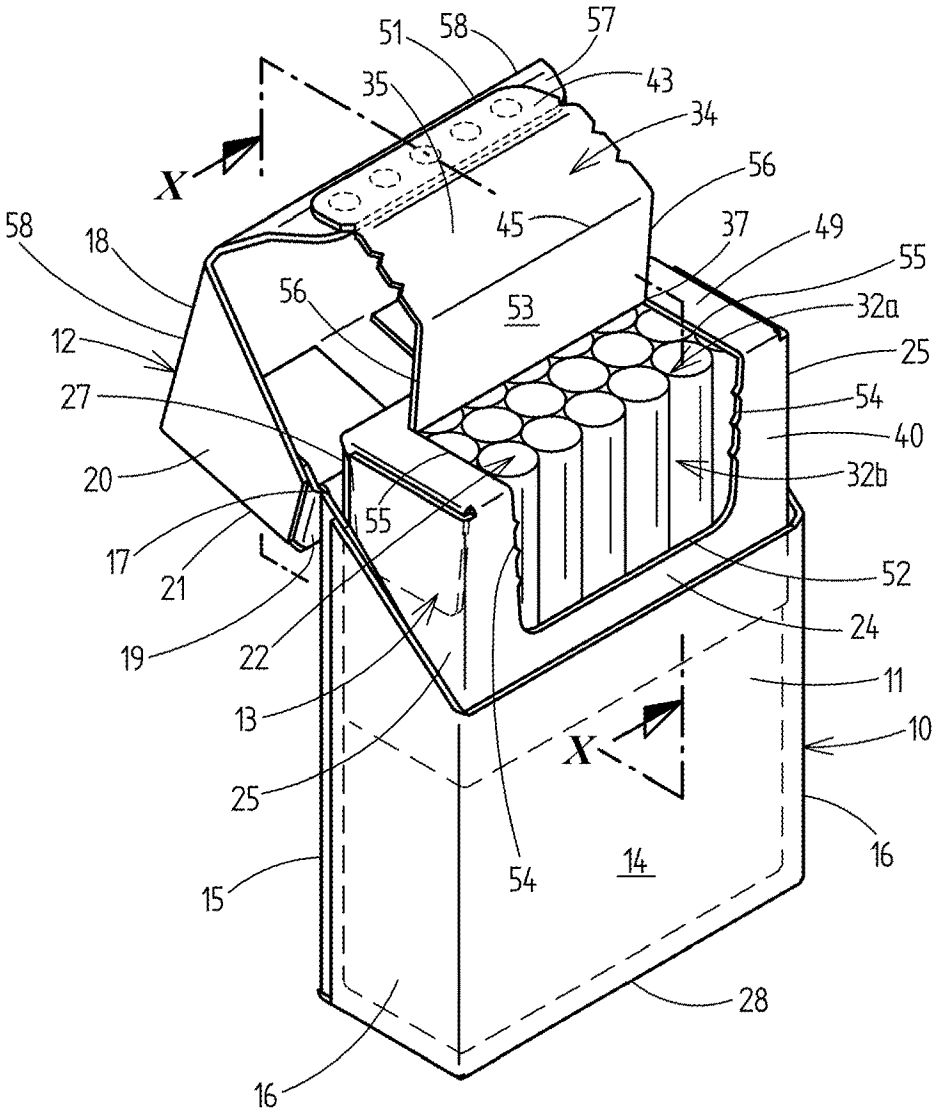
FIG. 9 shows a fifth embodiment of a pack according to the invention, with the lid of the outer pack opened, in a perspective view.

Exemplary Embodiment of FIGS. 9, 10

A further embodiment of a pack according to the invention is shown in FIGS. 9, 10. The points of differentiation of this embodiment to the embodiment of FIG. 7 will be substantially described hereunder. The features which are not described correspond to those of the embodiment of FIG. 7.

In the point of differentiation to the pack of FIG. 7, the connection portion 43 of the closure tab 35 is not connected to a component part of the lid 12 that is immovable relative to the lid 12, but to a movable component part of the lid 12.

For this purpose, the lid inner flap 57 is not fixedly connected to the lid outer flap 58 but, while forming an activation flap, is pivotally connected to said lid outer flap 58; specifically so as to be pivotable about a linear articulation 60 relative to the lid front wall 18 which presently has a single tier, said linear articulation 60 being formed by a fold line 59, in particular by a fold line 59 configured as a weakening line.

The lid inner flap 57, or the activation flap, respectively, preferably has a further fold line 61 which runs parallel at a spacing from the fold line 59, is configured in particular as a weakening line, is disposed between the (free) end edge 64 of the lid inner flap 57 and the fold line 59, and forms a further linear articulation 62 about which an end-proximal connection portion 63 of the lid inner flap 57, or activation flap, respectively, is pivotable.

The connection portion 43 of the closure tab 35 herein is connected (only) to the connection portion 63 of the lid inner flap 57 by way of the adhesive area or areas 44.

The connection portion 43 of the closure tab 35 and the lid inner flap 57 of the lid 12 herein are configured and connected to one another in such a manner that the lid inner flap 57 when opening the lid 12, by virtue of the pivoting movement along the linear articulation 60, is movable first to a preferably acute initial position and thereafter, under a continuing pivoting movement, to a transverse position, and finally to a stretched position, or to an obtuse position, respectively, relative to the lid front wall 18, while entraining in each case the closure tab 35, cf. in particular FIG. 10.

The further fold line 61, or the further linear articulation 62, respectively, herein ensures an enlarged range of movement of the closure tab 35, but is not mandatory according to the invention.

Figure 15:
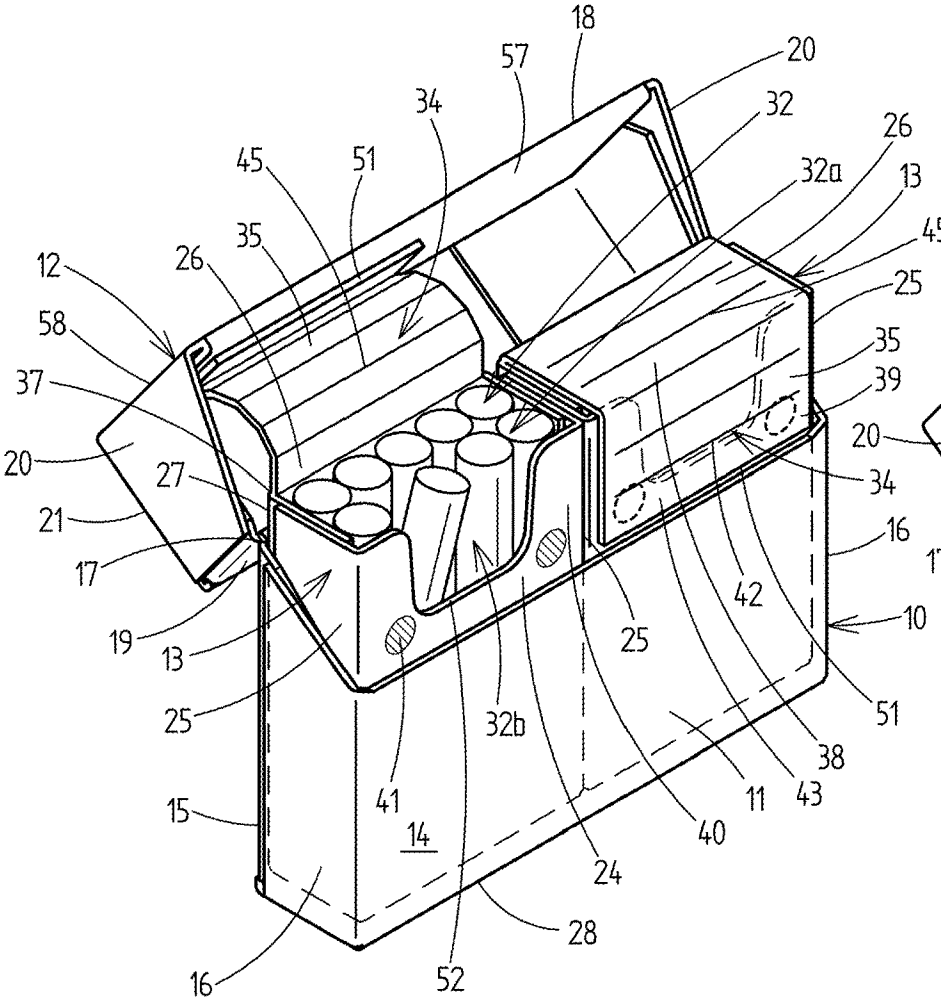
FIG. 15 shows an eighth embodiment of a pack according to the invention, having two separate inner packs disposed therein, with the lid of the outer pack opened, in a perspective view.

Exemplary Embodiment of FIG. 15

A further embodiment of a pack according to the invention is shown in FIG. 15. The points of differentiation of this embodiment to the embodiment of FIG. 2 will be substantially described hereunder. The features which are not described correspond to those of the embodiment of FIG. 3.

As can be seen, not only one inner pack 13 is disposed in the outer pack 10 of FIG. 15, as in the case of the pack of FIG. 2, but two individual inner packs 13 are disposed beside one another in the outer pack 10, which in each case are configured like the inner pack 13 of FIG. 2 and thus enclose in each case one cigarette group 22 on all sides, for example.

Accordingly, each of the two inner packs 13 also has a dedicated dimensionally stable closure means 34, or a closure tab 35, respectively, which is configured like in the case of the inner pack 13 of FIG. 2 and closes in each case a or the respective retrieval opening 32 prior to the initial use of the inner pack 13 or in a closing position, respectively.

For this purpose, the outer pack 10 presently is configured so as to be wider than the outer pack 10 of the pack of FIG. 2, for example so as to be double the width of the latter. The exact (relative) dimensions of the inner packs 13, or of the outer pack 10, respectively, are however not relevant. Rather, it is decisive that space for at least two inner packs 13 beside one another is found in the outer pack 10.

The closure tab 35 of the left inner pack 13 in FIG. 15 is fastened to the lid 12 of the outer pack 10 in a manner corresponding to the solution of FIG. 2, such that this closure tab 35 when opening the lid 12 of the outer pack 10 is automatically moved to the opening position. In contrast, the closure tab 35 of the right inner pack 13 is not adhesively bonded to the lid 12 such that a user can manually move this closure tab 35 to the opening position when required by gripping the front-side portion 39 of the closure tab 35, for example when the cigarettes situated in the left inner pack 13 all have been consumed and the left inner pack 13 is empty.

It is understood that it can also be provided that both closure tabs 35 are connected to the lid 12 in the manner mentioned.

As has also been indicated in the context of the explanations pertaining to the pack according to FIGS. 1 and 2, it is furthermore understood that it can also be provided that neither of the two closure tabs 35 are fastened to the lid 12.

As seen by the person skilled in the art, the two inner packs 13 of the outer pack 10 can moreover also be readily configured so as to correspond to the other embodiments described above and hereunder, or have one or a plurality of features of said embodiments, respectively.

This applies in particular but not only to the type of any potential configuration of the lid 12 and of the closure tab 35 in the case of any potential fastening of the respective closure tab 35 to the lid 12.

Figure 16:
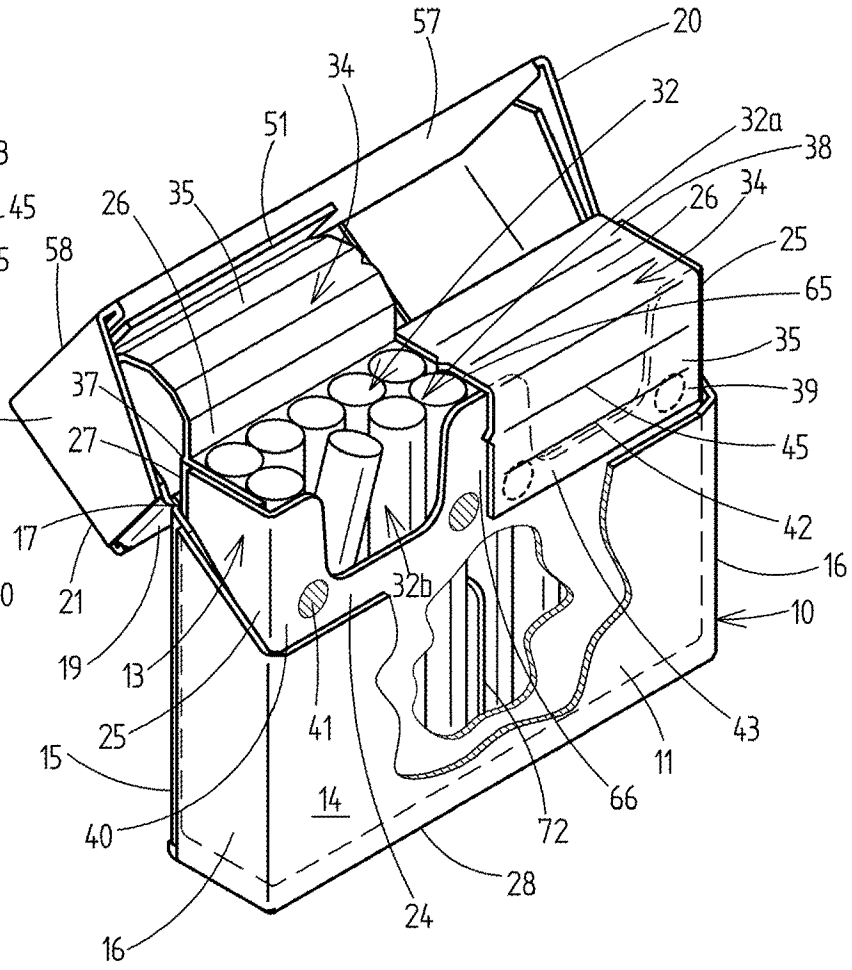
FIG. 16 shows a ninth embodiment of a pack according to the invention, having the inner pack, disposed therein, with two separate or separable closure means, respectively, with the lid of the outer pack opened, in a perspective view.

Exemplary Embodiment of FIG. 16

Figure 17:
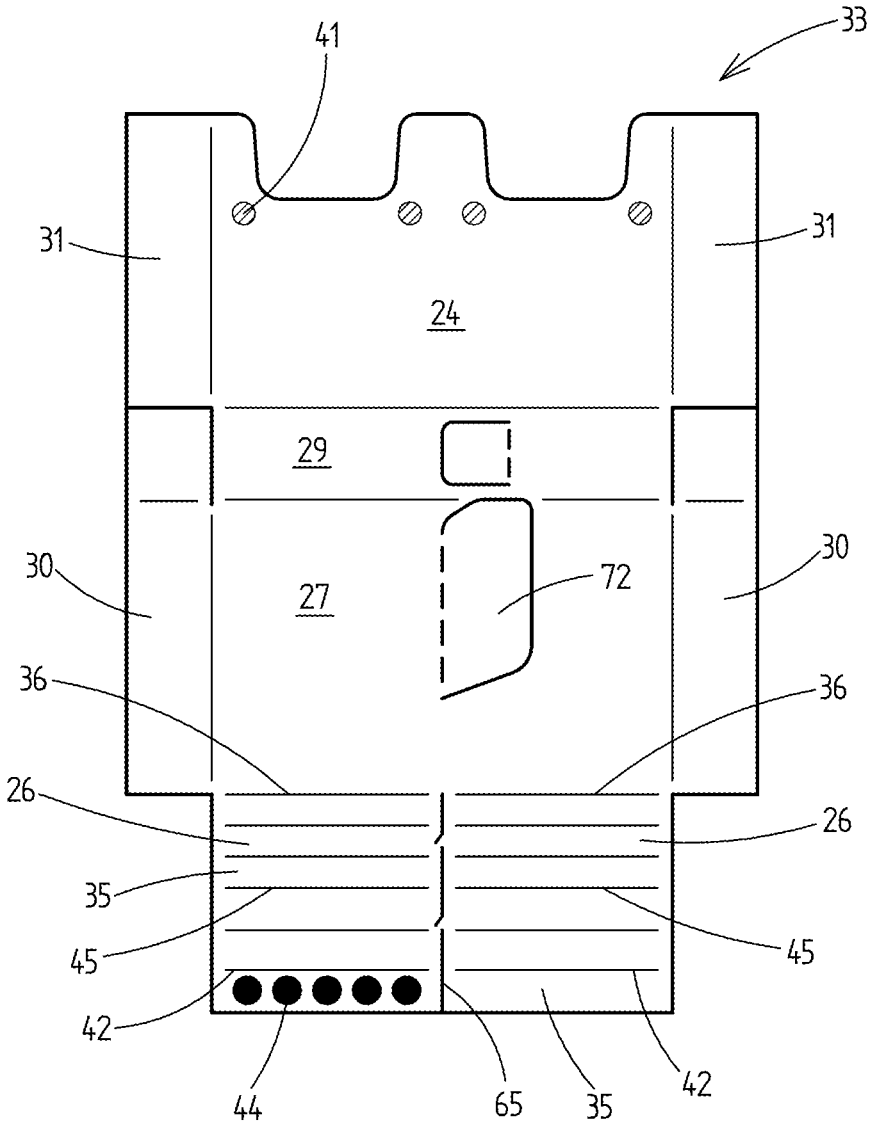
FIG. 17 shows a plan view of a blank for the production of the inner pack according to FIG. 16.

A further embodiment of a pack according to the invention is shown in FIGS. 16 and 17 (blank for the pack from FIG. 16).

Said embodiment, like the embodiments of FIGS. 1-11 described above, has in each case only one inner pack 13 however, in the point of differentiation to said embodiments, having not only one closure means 34 from a dimensionally stable material, or only one closure tab 35, respectively, but having two closure tabs 35 which are disposed beside one another and are releasably connected to one another by way of a tear-open line 65 (only) prior to the initial use of the inner pack 13.

Two cigarette groups 22 which in the interior of the inner pack 13 are separated from one another by a separation web 72 that runs so as to be in particular centric can be received in the inner pack 13 which may be configured so as to be wider than a conventional inner pack 13. The separation web 72 presently is integrally connected to the blank 33, for example to the inner rear wall 27.

Said separation web 72 while forming two separate receiving chambers for the cigarettes in the inner pack 13 extends transversely to the inner rear wall 27, or transversely to the inner front wall 24.

Prior to the initial use of the inner pack 13, the two closure tabs 35 conjointly close the end-side region 32*a* of the retrieval opening 32 that extends across the full width of the inner pack 13.

The two closure tabs 35 presently are configured in each case like the closure tab 35 of the inner pack of FIG. 2, but this is not mandatory.

Accordingly, each closure tab 35 presently is connected to the inner rear wall 27 of the inner pack 13 by way of a fold line 36. The fold line 36 forms a common linear articulation 37 about which the two closure tabs 35 are in each case pivotable (from the closing position to the opening position).

Each closure tab 35 possesses a dedicated end-side portion 38 which is formed by a segment, presently in each case one half, of the inner end wall 26 of the inner pack 13 that is formed conjointly by the two closure tabs 35.

The two end-side portions 38 conjointly, in the present case completely, cover the end-side region 32*a* of the retrieval opening 32.

Said two end-side portions 38 herein extend conjointly across the entire width of the inner pack 13 or of the end-side region 32*a* of the retrieval opening 32, respectively, specifically from the one inner narrow-side wall 25 to the other, opposite, parallel inner narrow-side wall 25. Furthermore, said two end-side portions 38 extend in each case across the entire depth of the inner pack 13 or of the end-side region 32*a*, respectively, thus from the inner front wall 24 up to the opposite inner rear wall 27.

In the closed position of the two closure tabs 35, or prior to the initial use of the inner pack 13, respectively, the respective end-side portions 38 of said two closure tabs 35 by way of a lateral periphery bear in each case on the respectively assigned upper edge of the respective inner narrow-side wall 25, or are supported by the latter, respectively.

The retrieval opening 32 of the inner pack 13 in the present case has two neighboring front-side regions 32*b* which are separated from one another by a separation web 66 that is formed by the inner front wall 24.

The respective front-side portion 39 of each closure tab 35 in the closed position of the respective closure tab 35 herein covers in each case one of the two neighboring front-side regions 32*b* of the retrieval opening 32 above the respective retrieval opening plane.

Furthermore, the respective front-side portion 39 of each closure tab 35 additionally covers in each case at least in regions a peripheral region 40 that surrounds the respective front-side region 32*b* of the retrieval opening 32 and that is adjacent to the respective front-side region 32*b* of the retrieval opening 32.

The front-side portion 39 of each closure tab 35, in particular for manufacturing purposes, is releasably fastened to the inner front wall 24 by way of one or a plurality of repeatedly effective, releasable, adhesive areas 41, presently adhesive spots.

As in the embodiment of FIG. 2, each closure tab 35 has an end-side connection portion 43 which by way of a fold line 42 is integrally connected to said closure tab 35 and which by means of one or a plurality of adhesive areas 44 is permanently connected to the internal side of the lid front wall 18 such that the closure tab 35 when opening the lid 12 is entrained and automatically pivoted from the closing position of said closure tab 35 to the opening position of said closure tab 35.

In order to impart to the dimensionally stable material of the respective closure tab 35 a certain flexibility, on account of which the conversion of the closure tab 35 to the opening position thereof (and vice versa) is facilitated, it can be provided also here that a plurality of weakening lines 45 that run parallel to one another are disposed on the internal side of each closure tab 35, or are integrated in the closure tab 35, respectively, for example as grooves, scorings or perforations. The weakening lines 45 can in each case preferably extend across the entire width of the closure tab 35.

Likewise as in the embodiment of FIG. 2, the lid front wall 18 at least in regions is formed in two tiers from a lid outer flap 58 and a lid inner flap 57 which is fixedly connected to the latter, wherein each closure tab 35, specifically in each case one end-side connection portion 43 thereof, is adhesively bonded to the internal side of the lid inner flap 57. It is also understood here that the lid front wall 18 does not mandatorily have to be configured with two tiers.

The one (left) closure tab 35 in FIG. 16 in a manner corresponding to the solution of FIG. 2 is moreover fastened to the lid 12 of the outer pack 10 such that this closure tab 35 when opening the lid 12 of the outer pack 10 is automatically moved to the opening position.

In contrast, the other (right) closure tab 35 is not adhesively bonded to the lid 12 such that a user can manually move this closure tab 35 to the opening position when required by gripping the front-side portion 39 of the closure tab 35, for example when the cigarettes situated in the left inner pack 13 all have been consumed and the left inner pack 13 is empty.

It is understood that it can also be provided that both closure tabs 35 are connected to the lid 12 in the manner mentioned. It is furthermore understood, as is also indicated in the context of the explanations pertaining to the pack according to FIGS. 1 and 2, that it can also be provided that neither of the two closure tabs 35 are fastened to the lid 12.

As seen by the person skilled in the art, the inner pack 13 of the outer pack 10 of the present pack can moreover also be readily configured so as to correspond to the other embodiments described above and hereunder.

This applies in particular also but not only to the configuration of the closure tabs 35 which could in each case also be integrated in the inner side wall 26, or the inner front wall 24, respectively, of the inner pack 13, for example, as is shown in FIGS. 5-10.

This applies in particular also but not only to the type of any potential configuration of the lid 12 and of the closure tab 35 in the case of any potential fastening of the respective closure tab 35 to the lid 12.

Figure 12:
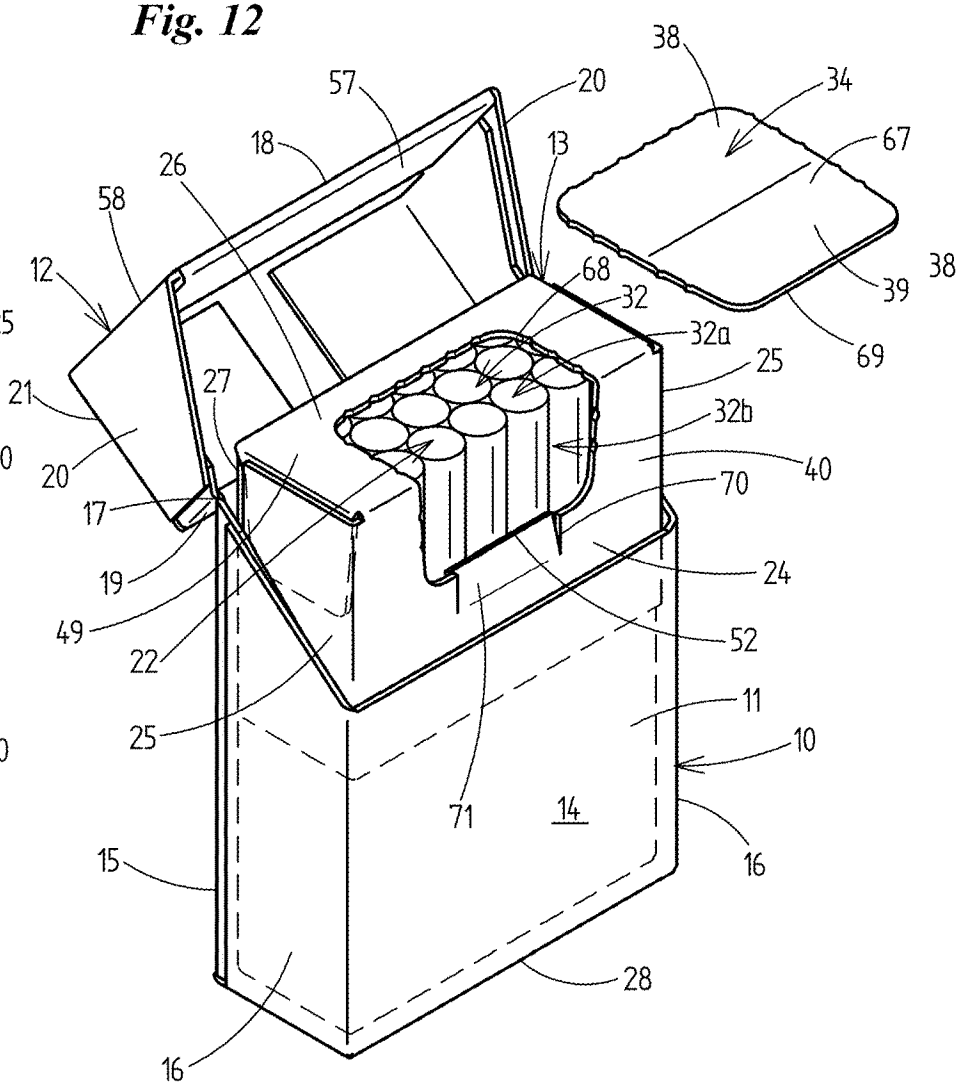
FIG. 12 shows the pack from FIG. 11 in an analogous illustration, with the closure means of the inner pack removed from the inner pack.
Figure 11:
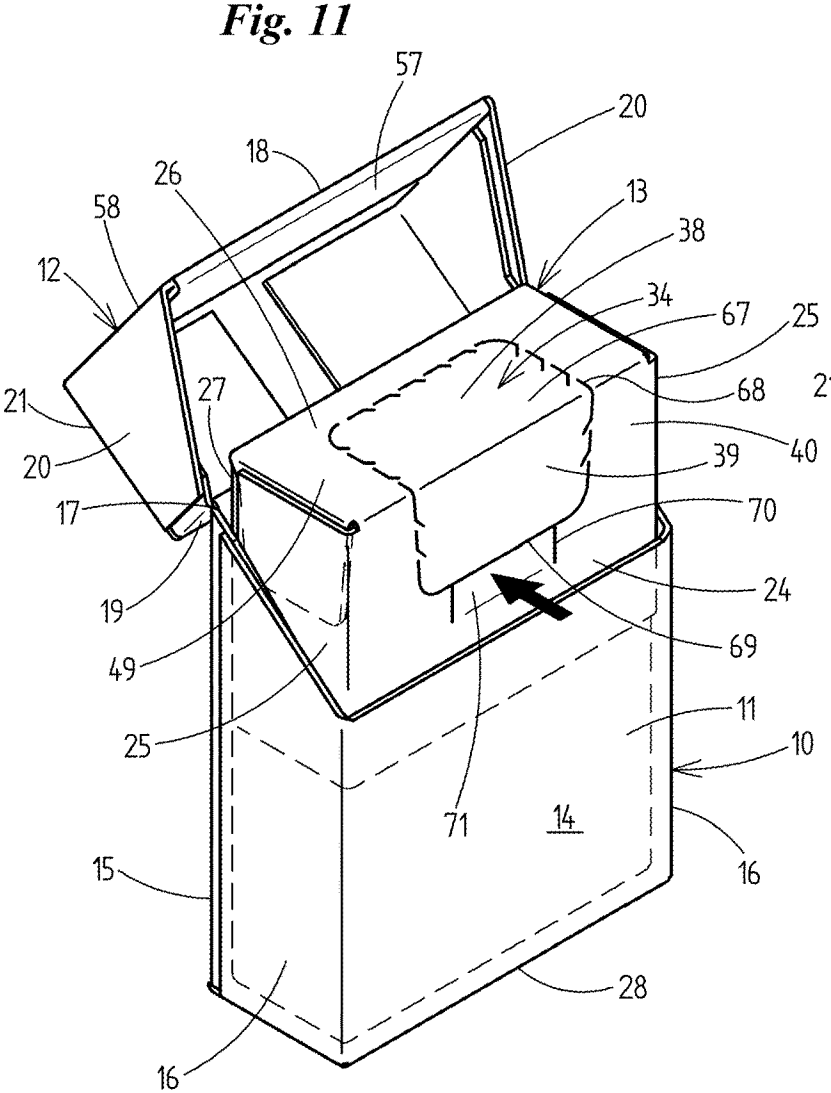
FIG. 11 shows a sixth embodiment of a pack according to the invention, with the lid of the outer pack opened, in a perspective view.

Exemplary Embodiment of FIGS. 11, 12

A further embodiment of a pack according to the invention is shown in FIGS. 11, 12. The points of differentiation of this embodiment to the embodiment of FIG. 6 will be substantially described hereunder. The features which are not described correspond to those of the embodiment of FIG. 6.

Figure 14:
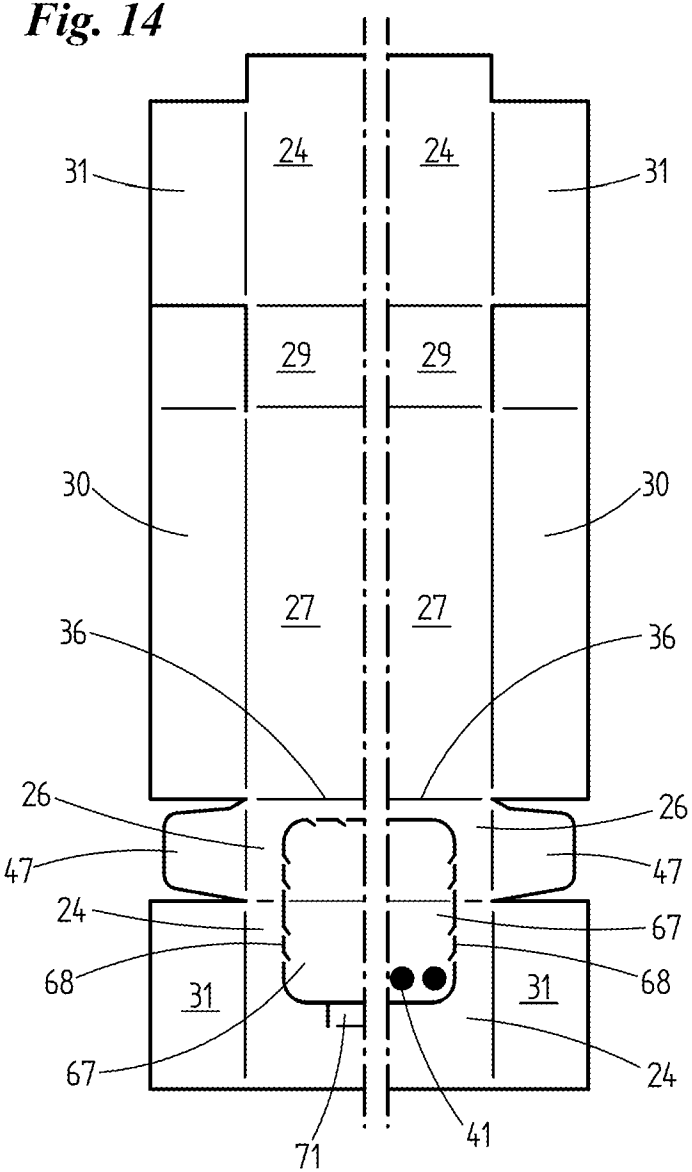
FIG. 14 shows a plan view of a blank for the production of the inner pack according to FIGS. 11/12 (left half of blank) or FIG. 13 (right half of blank)

In the point of differentiation to the exemplary pack of FIG. 6, the inner pack 13 of the pack of FIGS. 11 and 12 and 14, respectively (left half of blank) has a dimensionally stable closure means 34 which is not configured as a closure tab 35 that is pivotably disposed on the inner pack 13, but as a closure piece 67, or as a tear-off flap, respectively, that is able to be completely removed from the inner pack 13.

The closure piece 67 prior to the initial use of the inner pack 13 herein is integrally releasably connected to the inner pack 13. In the initial use of the inner pack 13, said closure piece 67, while releasing a retrieval opening 32, in the plane(s) said closure piece 67 extends can be completely separated from the inner pack 13 along a presently in particular U-shaped tear-off line 68, in particular of perforations or scorings, by way of which the closure piece 67 is releasably connected to the inner end wall 26 as well as to the inner front wall 24, cf. FIG. 12.

A front-side portion 39 of the closure piece 67 is formed by a segment of the inner front wall 24 of the inner pack 13 and extends in the front-side region 32*b* of the retrieval opening 32, and an end-side portion 38 is formed by a segment of the inner end wall 26 and extends in the front-side region 32*b* of the retrieval opening 32.

Accordingly, the closure piece 67 prior to the initial use of the inner pack extends in the same plane as the adjacent peripheral piece, or the adjacent peripheral strip 40 or 49, respectively, of the inner front wall 26, or of the inner end wall 24, respectively, in the respective retrieval opening plane of the retrieval opening 32, or of the front-side or end-side region 32*b* or 32*a* of the retrieval opening, respectively.

The closure piece 67, specifically the end-side portion 38 thereof, prior to the initial use of the inner pack 13 herein is delimited by the in particular U-shaped peripheral region 49 of the inner end wall 26 of the inner pack 13, and the front-side portion 39 is delimited by the in particular U-shaped peripheral region 40 of the inner front wall 24.

In general terms, the closure piece 67 by way of a contiguous peripheral piece, or a contiguous peripheral region of the inner pack 13, respectively, that prior to the initial use of the inner pack 13 extends across the inner front wall 24 and the inner end wall 26 of the inner pack 13 is spaced apart from those external edges of the inner pack 13 that are (co-)defined by the inner front wall 24 and the inner end wall 26 of the inner pack 13 and lie opposite, in particular parallel to, the respective peripheries of the closure piece 67.

In the peripheral portions in which the closure piece 67 is not releasably connected to the peripheral region 40 of the inner front wall 24, or the peripheral region 49 of the inner end wall 26, respectively, by way of the tear-open line 68, free peripheral edges or peripheral edge portions, respectively, of the closure piece 67 lie substantially seamlessly opposite corresponding edges of the segments of the inner end wall 26, or of the inner front wall 24, respectively, that surround the retrieval opening 32.

Specifically, at least one (lower) edge 69 of the closure piece 67 lies presently opposite in an unconnected manner a corresponding edge 52 of the peripheral region 40 of the inner front wall 24 that delimits the front-side region 32*b* of the retrieval opening 32 so as to facilitate the tearing-off of the closure piece 67.

As opposed to the closure tab 35 in the exemplary embodiment of FIG. 6, the closure piece 67 presently is not fastened to the lid 12 such that a user has to manually remove or tear off, respectively, the closure piece 67.

In order for this tear-off procedure to be further facilitated, an indentation tab 71 which is delimited presently by two incisions 70, is adjacent to the closure piece 67, presently adjacent to the lower edge 69, and, for facilitating the separation of the closure piece 67 from the inner pack 13, can be indented by a user towards the inside in the direction of the interior of the inner pack 13 is formed in the inner front wall 24 of the inner pack 13.

Figure 13:
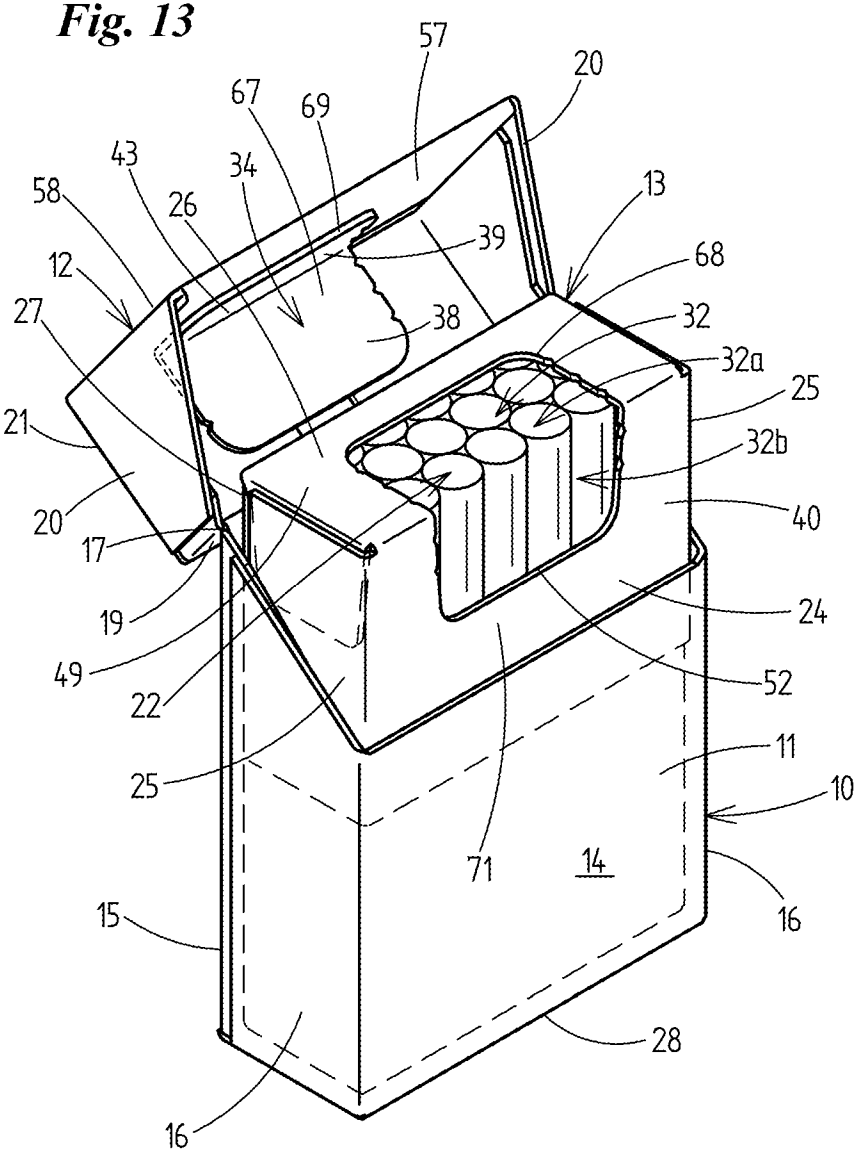
FIG. 13 shows a seventh embodiment of a pack according to the invention, with the lid of the outer pack opened, in a perspective view, with the closure means fastened to the lid of the outer pack.

Exemplary Embodiment of FIG. 13

The points of differentiation of the embodiment of FIGS. 13 and 14, respectively, (right half of blank) to the embodiment of FIGS. 11, 12 will be substantially described hereunder. The features which are not described correspond to those of the embodiment of FIGS. 11, 12.

As opposed to the embodiment of FIGS. 11, 12, the closure piece 67 in the pack of FIG. 13 is fastened to the lid 12 of the outer pack such that in the initial use of the pack, or of the inner pack 13, respectively, the closure piece 67 by pivoting the lid 12 is automatically torn off along the tear-open line 68 and completely removed from the inner pack 13. Accordingly, an indentation tab 71 is also not required.

Specifically, a connection portion 43 of the front-side portion 39 of the closure piece 67 herein by one or a plurality of adhesive areas 41 is presently adhesively bonded to the internal side of the lid 12, in particular to the internal side of the lid inner flap 57.

As seen by the person skilled in the art, the inner pack 13 or the outer pack 10, respectively, can moreover also be readily configured so as to correspond to the other embodiments described above and hereunder, or have one or a plurality of features of the latter, respectively.

This applies in particular but not only to the type of any potential configuration of the lid 12 in the case of any potential fastening of the respective closure piece 67 to the lid 12.

LIST OF REFERENCE SIGNS

10 Outer pack
11 Box part
12 Lid
13 Inner pack
14 Box part front wall
15 Box part rear wall
16 Box part narrow-side wall
17 Linear articulation
18 Lid front wall
19 Lid rear wall
20 Lid lateral wall
21 Lid end wall
22 Cigarette group
23 Inner sheathing
24 Inner front wall
25 Inner narrow-side walls
26 Inner end wall
27 Inner rear wall
28 Box part base wall

29 Inner base wall
30 Internal inner lateral flaps
31 External inner lateral flaps
32 Retrieval opening
32*a* End-side region retrieval opening
32*b* Front-side region retrieval opening
33 Blank
34 Closure means
35 Closure tab
36 Fold line
37 Linear articulation
38 End-side portion closure tab
39 Front-side portion closure tab
40 Peripheral region inner front wall
41 Adhesive areas front-side portion
42 Fold line
43 Connection portion closure tab
44 Adhesive areas connection portion
45 Weakening lines
46 Tear-open lines narrow-side walls
47 Corner side flap
48 Fold line
49 Peripheral region inner end wall
50 Remaining connection
51 Lower edge connection portion
52 Lower edge peripheral region inner front wall
53 Internal side closure tab
54 Tear-open lines front-side portion
55 Lateral edges peripheral region inner end wall
56 Lateral edges end-side portion closure tab
57 Lid inner flap
58 Lid outer flap
59 Fold line lid inner flap
60 Linear articulation lid inner flap
61 Fold line connection portion
62 Linear articulation connection portion
63 Connection portion lid inner flap
64 Free end edge lid inner flap
65 Tear-open line
66 Separation web retrieval opening
67 Removable closure piece
68 Tear-open line closure piece
69 Lower edge closure piece
70 Incisions
71 Indentation tab
72 Separation web inner pack

The invention claimed is:

1. A pack for products of the cigarette industry, having an outer pack (10) which is made from a blank of a dimensionally stable material and is configured as a flip pack having a box part (11) and a lid (12), and having at least one cuboid inner pack (13) which is likewise made from a blank of a dimensionally stable material, is disposed in the outer pack (10) and encloses the products on all sides, wherein the inner pack (13) has a closure means (34) which prior to the initial use of the inner pack (13) closes a retrieval opening (32) for retrieving individual products which extends at least in an end-side region of the inner pack (13), and which closure means (34) is able to be converted from the state closing the retrieval opening (32) to a state releasing the retrieval opening (32), wherein the closure means (34) is composed of a dimensionally stable material, wherein the closure means (34) is a pivotably mounted closure tab (35) which is integrally connected to the inner pack (13) and is pivotable from the state closing the retrieval opening (32), specifically a closing position, to the state releasing the retrieval opening (32), specifically an opening position, and wherein the closure tab (35) has a connection portion which is integrally connected to the closure tab (35) by way of a fold line and which, by means of an adhesive, is permanently fastened to the lid of the outer pack (10) such that the closure tab (35) when opening the lid is automatically pivoted from the closing position of the closure tab (35) to the opening position of the closure tab (35).

2. The pack according to claim 1, wherein the closure tab (35) is pivotably mounted by means of a linear articulation which is formed by a fold line which connects the rear wall and the end wall of the inner pack (13) to one another, or which is formed by a fold line which is part of the end wall of the inner pack (13) and runs at a spacing from the inner pack edge that connects the rear wall and the end wall of the inner pack (13) to one another.

3. The pack according to claim 1, wherein an end-side portion of the closure tab (35) is formed by the end wall of the inner pack (13), namely by the entire end wall or by a segment of the inner pack (13), and/or in that a front-side portion of the closure tab (35) is formed by a segment of the front wall of the inner pack (13).

4. The pack according to claim 3, wherein the end-side portion and/or the front-side portion of the closure tab (35) prior to the initial use of the inner pack (13), by way of one or a plurality of tear-open lines, namely from perforations or scorings, is connected either to adjacent narrow-side walls of the inner pack (13) or to one or a plurality of adjacent segments of the end wall, or of the front wall, respectively, of the inner pack (13).

5. The pack according to claim 3, wherein the retrieval opening (32) in a full length defined by the spacing of two parallel upright narrow-side walls of the inner pack (13) is covered by the end-side portion of the closure tab (35) that is formed by the end wall of the inner pack (13).

6. The pack according to claim 5, wherein the end-side portion of the closure tab (35) prior to the initial use of the inner pack (13) bears so as to be unconnected on free upper edges of the narrow-side walls.

7. The pack according to claim 1, wherein the blank of the inner pack (13) is composed of material having an aroma and/or a moisture barrier.

8. The pack according to claim 3, wherein the front-side portion of the closure tab (35) in the closing position of the inner pack (13) in regions bears externally on the front wall of the inner pack (13), namely is fastened to the front wall of the inner pack (13) by means of a releasable adhesive.

9. The pack according to claim 3, wherein the front-side portion of the closure tab (35) in the closing position completely covers a portion, or the portion, respectively, of the retrieval opening (32) that extends in the front-side region of the inner pack (13).

10. The pack according to claim 9, wherein the front-side portion of the closure tab (35) covers a lateral peripheral region of the front wall of the inner pack (13), the portion of the retrieval opening (32) that extends in the front-side region of the inner pack (13) being adjacent to said lateral peripheral region.

11. The pack according to claim 6, wherein the free edges, created after the initial use of the inner pack (13), of that front-side portion of the closure tab (35) which is formed by the segment of the front wall of the inner pack (13) and/or the free edges, created after the initial use of the inner pack (13), of that end-side portion of the closure tab (35) which is formed by the segment of the end wall or by the entire end wall in the closing position of the closure tab (35) lie seamlessly, or substantially seamlessly, opposite assigned free edges of the inner pack (13) that are adjacent to the retrieval opening (32), or delimit the retrieval opening (32), respectively, the free edges being free edges of the adjacent segment of the front wall and/or of the adjacent segment of the end wall and/or of the entire end wall of the inner pack (13).

12. The pack according to claim 11, wherein the front-side portion and/or the end-side portion of the closure tab (35) in the closing position of the closure tab (35) extend in the same plane as the respectively adjacent segment of the front wall or of the end wall, respectively, of the inner pack (13).

13. A pack for products of the cigarette industry, having an outer pack (10) which is made from a blank of a dimensionally stable material and is configured as a flip pack having a box part (11) and a lid (12), and having at least one cuboid inner pack (13) which is likewise made from a blank of a dimensionally stable material and is disposed in the outer pack (10), wherein the inner pack (13) encloses in each case the products on all sides, and wherein the inner pack (13) has at least two closure means (34) which prior to the initial use of the respective inner pack (13) conjointly close a retrieval opening (32) for retrieving individual products which extends at least in an end-side region of the respective inner pack (13), wherein each closure means (34) is able to be converted from the state closing the retrieval opening (32) to a state at least in regions releasing the retrieval opening, wherein each closure means (34) of the inner pack (13) is composed of a dimensionally stable material, wherein a or each closure tab (35) has a connection portion which is connected by way of a fold line and which, by means of an adhesive, is permanently fastened to the lid (12) of the outer pack (10) such that the closure tab (35) when opening the lid (12) is automatically pivoted from the closing position of the closure tab (35) to the opening position of the closure tab (35).

14. The pack according to claim 13, wherein only the one closure tab (35) of the inner pack (13) is fastened to the lid (12) of the outer pack (10), and in that the other closure tab (35) is not fastened to the lid (12) of the outer pack (10).

15. The pack according to claim 13, wherein an end-side portion of each closure tab (35) is formed by in each case one segment of the end wall of the inner pack (13), and/or in that a front-side portion of each closure tab is formed by one segment of the front wall of the inner pack (13).

16. The pack according to claim 15, wherein the retrieval opening (32) of the inner pack (13) in the a length defined by the spacing of two parallel upright narrow-side walls of the inner pack (13) is covered conjointly by both closure tabs (35) which are disposed beside one another and are mutually adjacent on one side.

17. The pack according to claim 13, wherein the two front-side portions of the closure tabs (35), prior to the initial use of the inner pack (13) are connected to one another by way of one or a plurality of tear-open lines, in the form of perforations or scorings, a separation of the two closure tabs (35) taking place or being able to take place along the tear-open lines during the initial use of the inner pack (13).

* * * * *